US008388247B2

(12) United States Patent
Ichikawa

(10) Patent No.: US 8,388,247 B2
(45) Date of Patent: Mar. 5, 2013

(54) IMAGE FORMING DEVICE HAVING MECHANISM FOR DETECTING DETECTION TARGET

(75) Inventor: Hiroshi Ichikawa, Okazaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1068 days.

(21) Appl. No.: 12/364,094

(22) Filed: Feb. 2, 2009

(65) Prior Publication Data

US 2009/0213391 A1 Aug. 27, 2009

(30) Foreign Application Priority Data

Feb. 26, 2008 (JP) ..... 2008-044628

(51) Int. Cl.
*B65H 7/14* (2006.01)
*G03G 15/00* (2006.01)

(52) U.S. Cl. ..... 400/708; 250/559.12; 271/265.01

(58) Field of Classification Search ..... 400/708, 400/708.1; 250/206.3; 399/392, 388; 271/9.09
See application file for complete search history.

(56) References Cited

U.S. PATENT DOCUMENTS

| | | | | |
|---|---|---|---|---|
| 5,649,697 | A * | 7/1997 | Kurishita et al. | 271/97 |
| 2005/0236760 | A1* | 10/2005 | Kang | 271/152 |
| 2006/0157921 | A1* | 7/2006 | Ahn et al. | 271/258.01 |
| 2007/0075238 | A1* | 4/2007 | Braun | 250/239 |

FOREIGN PATENT DOCUMENTS

| | | | |
|---|---|---|---|
| JP | 03115039 | * | 5/1991 |
| JP | 5-278897 | | 10/1993 |
| JP | H08-225187 | | 9/1996 |
| JP | 2005-162342 | | 6/2005 |
| JP | 2006164581 | * | 6/2006 |
| JP | 2007297141 | * | 11/2007 |

* cited by examiner

*Primary Examiner* — Judy Nguyen
*Assistant Examiner* — Ruben Parco, Jr.
(74) *Attorney, Agent, or Firm* — Scully, Scott, Murphy & Presser, PC

(57) ABSTRACT

An image forming device having a detection assembly that detects a detection target. The detection assembly includes an actuator having a shaft rotatable about its axis, an abutment portion extending from the shaft and pivotally movable upon abutment of the detection target, and a detected portion pivotally movable about the axis. A detection board is supported to a stationary base component and includes a detection unit for detecting the detected portion. The shaft has one end portion supported to the base component, and another end portion supported to the detection board. Relative positional relationship between the actuator and the detection unit is maintained by the direct supporting manner of the shaft by the detection board.

10 Claims, 19 Drawing Sheets

RIGHT ⟷ LEFT

IMAGE FORMING DEVICE HAVING MECHANISM FOR DETECTING DETECTION TARGET

CROSS-REFERENCE TO RELATED APPLICATION

This application claims priority from Japanese Patent Application No. 2008-44628 filed Feb. 26, 2008. The entire content of the priority application is incorporated herein by reference.

TECHNICAL FIELD

The present invention relates to an image forming device for forming an image on a recording medium, and more particularly, to the image forming device provided with a detection assembly that detects a detection target such as the recording medium, an original, and a component of the image forming device such as a detachable cartridge. The present invention also relates to a detector unit available for the image forming device.

BACKGROUND

In order to detect a detection target such as a recording medium, an original, and a component of the image forming device, an abutment portion and a detecting element are conventionally provided. The abutment portion is pivotally movable about an axis of a shaft upon abutment of the detection target to the abutment portion. The detecting unit is adapted to detect a detected portion that is also pivotally moved together with the abutment portion. For example, when the recording medium is brought into abutment with the abutment portion, the detected portion is moved concurrent with the pivotal movement of the abutment portion. Thus, the detecting unit detects the detected portion to generate a detection signal. Accordingly, various control is achievable in response to the detection signal. In this type of image forming device, the shaft of the abutment portion is attached to a paper end sensor serving as the detecting unit as described in laid-open Japanese Patent Application Publication No. H08-225187.

However, in order to produce such assembly described in the JP publication, a custom-ordered paper end sensor must be used so that the paper end sensor is provided with a bearing portion. A positioning error of the detection element with respect to a base member which supports the shaft, or positioning error of the shaft with respect to the base member may affect detection accuracy in case pivotal motion of the abutment portion is detected by an ordinary detecting element fixed to a print circuit board. To overcome this drawback, a design change is required to enlarge a pivot angle of the abutment portion. Consequently, a range of design choice may be restricted.

SUMMARY

In view of the foregoing, it is an object of the present invention to provide an image forming device capable of improving detection accuracy even by an employment of an ordinary detection element in order to detect a detection target such as an image recording medium, an original, and a component of the image forming device.

In order to attain the above and other objects, the invention provides an image forming device including an image forming unit for forming an image on a recording medium, a base component, and a detection assembly including a shaft, an abutment portion, a detected portion, a detection unit, and a detection board. The detection assembly is adapted to detect a detection target. The abutment portion is pivotally movable about an axis of the shaft upon abutment of the detection target onto the abutment portion. The detected portion is movable integrally with the abutment portion and is pivotable between a detected position and a non-detected position. The detection unit detects the detected portion upon the detected portion being moved to the detected position. The detection board fixes the detection unit and is supported to the base component. The shaft extends through the detection board, whereby a relative positional relationship between the shaft and the detection board is fixed.

In another aspect of the invention, there is provided a detector unit including an actuator having a shaft, and a board formed with a hole through which the shaft extends. The board includes a detector configured to detect the actuator. The actuator is configured to move between a first position where the detector detects the actuator and a second position where the detector misses detecting the actuator.

DETAILED DESCRIPTION

Figure 1:
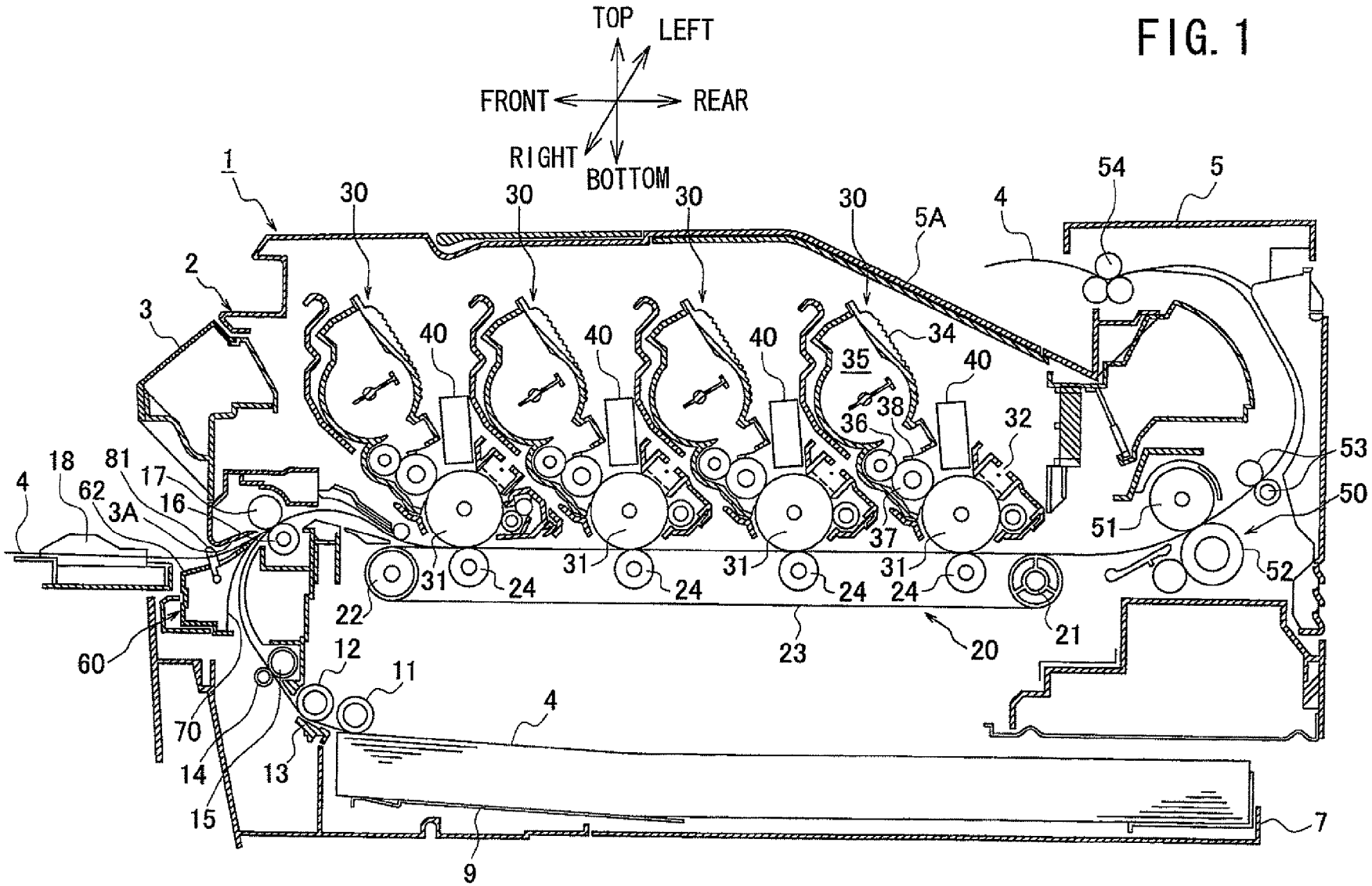
FIG. 1 is a schematic cross-sectional side view of an image forming device according to a first embodiment of the present invention.

An image forming device according to one embodiment of the invention will be described with reference to FIGS. 1 through 8. Throughout the specification, the terms "upward", "downward", "upper", "lower", "above", "below", "beneath", "right", "left", "front", "rear" and the like will be used throughout the description assuming that the image forming device is disposed in an orientation in which it is intended to be used. In use, the image forming device is disposed as shown in FIG. 1 where a left side is a front side, and a right side is a rear side.

The image-forming device 1 is a color printer of a direct image-transfer tandem type. As shown in FIG. 1, the printer 1 has a generally box shaped casing 2. A front cover 3 is provided at a front side of the casing 2, and a top cover 5 is provided at a top side of the casing 2. The top cover 5 is pivotally movable about a pivot shaft (not shown) at a rear top side of the casing 2 for opening and closing the casing 2. A discharge tray 5A is provided integrally with the top cover 5 for receiving and holding sheets 4, such as paper sheets and OHP sheets (hereinafter simply referred to as "sheet") discharged from the casing 2 after printing.

A sheet tray 7 is assembled to a lower portion of the casing 2 for accommodating therein a stack of sheets 7. The sheet tray 7 can be pulled out of the casing 2 from a front side thereof. A pressure plate 9 is disposed in the sheet tray 7. The pressure plate 9 is biased upward so that a front end thereof is pivotally moved upward in order to lift a leading end side of the sheets on the pressure plate 9. A sheet supply roller 11 is disposed above the front end of the sheet tray 7 for supplying an uppermost sheet of the sheet stack in the sheet tray 7. A separation roller 12 and a separation pad 13 are disposed immediate downstream of the sheet supply roller 11 for separating the uppermost sheet 7 from the sheet stack on the sheet tray 7 by applying a prescribed resistance to the uppermost sheet so that one sheet is fed at a time individually.

A paper dust removing roller 14 and an opposing roller 15 are provided immediately downstream of the separation roller 12 for removing dust from the sheet 7 supplied from the separation roller 12. A chute member 70 made from a metal plate is provided downstream of the rollers 14 and 15 for guiding travel of the sheet 4 fed from the rollers 14 and 15. A pair of register rollers 16, 17 are provided at the chute member 70 for delivering each sheet at a predetermined timing toward a belt section 20 described later.

A manual insertion tray 18 is provided at the front cover 3. A sheet passage reaching the register rollers 16, 17 spans between the manual insertion tray 18 and the chute member 70. Thus, the sheet fed through the manual insertion tray 18 can also be delivered to the belt section 20 through the register rollers 16, 17.

The belt section 20 is detachably attached to the casing 2. The belt section 20 is accessible by a user by opening the top cover 5 in order to manually pull the belt section 20 upward. The belt section 20 includes a drive roller 21, a tension roller 22 rotatably disposed at a position away from the drive roller 21, and an endless conveying belt 23 horizontally stretched around the drive roller 21 and tension roller 22. The endless conveying belt 23 is circularly movable in a clockwise direction in FIG. 1 upon rotation of the drive roller 21 for conveying the sheet 4 mounted on the belt 23 rearward. The belt 23 is made from a resin, such as polycarbonate.

Details of an image-forming unit will be described. Four transfer rollers 24 are arrayed in line with a constant pitch and are disposed in contact with an inner peripheral surface of the conveying belt 23. Four photosensitive drums 31, each in confrontation with each transfer roller, are disposed in contact with an outer peripheral surface of the conveying belt 23. For transferring toner image, a transfer bias is applied between the transfer roller 24 and the photosensitive drum 31 for flowing predetermined level of transfer current.

Four image forming sections 30 for black, cyan, magenta and yellow are provided in association with four LED sections 40. Four pairs of image forming section 30 and LED section 40 are arrayed in line in the sheet conveying direction. A combination of the image forming section 30, the LED section 40 and the belt section 20 constitute an image forming unit.

The image forming section 30 includes the photosensitive drum 31, a scorotron charger 32, and a developing cartridge 34. The photosensitive drum 31 includes a metallic drum body grounded, and a positive-charging photosensitive layer formed over an outer peripheral surface of the drum body. The charger 32 is disposed diagonally above and rearward of the photosensitive drum 31, opposing the photosensitive drum 31, but is spaced away by a prescribed distance therefrom. The charger 32 is adapted to produce a corona discharge for charging the surface of the photosensitive drum 31 with a substantially uniform positive polarity.

The developing cartridge 34 has a generally box shape, and has an upper inner portion defining a toner chamber 35, and has a lower inner portion provided with a toner supply roller 36, a developing roller 37, and a regulation blade 38. A single component type and positively chargeable non-magnetic toners of black, cyan, magenta and yellow colors are respectively accommodated in the toner chambers 35. The toner supply roller 36 is adapted to supply toner from the toner chamber 35 to the developing roller 37 upon rotation of the toner supply roller 36. The toner on the developing roller 37 is triboelectrically charged with positive polarity between the toner supply roller 36 and the developing roller 37. The regulation blade 38 is adaped for regulating a thickness of a toner layer formed on the developing roller 37. Further, positive-charging of the toner is promoted when the latter is held between the regulation blade 38 and the developing roller 37 upon rotation of the developing roller 37.

The scorotron charger 32 is adapted to uniformly charge the surface of the photosensitive drum 31 with a positive polarity upon rotation of the photosensitive drum 31. The LED unit 40 includes an array of LEDs (not shown) extending in an axial direction of the photosensitive drum 31 (widthwise direction of the sheet 4). The LED unit 40 is adapted to expose the surface of the photosensitive drum 31 to light to form an electrostatic latent image thereon corresponding to an image to be formed on the sheet 4.

Upon rotation of the developing roller 37, the positively charged toner carried on the developing roller 37 will be supplied to the electrostatic latent image area on the photosensitive drum 31 when the toner is brought into contact with the photosensitive drum 31, whereupon a visible toner image corresponding to the electrostatic latent image is formed on the surface of the photosensitive drum 13.

Then, the toner image on the photosensitive drum will be transferred, by the transfer bias, onto the sheet 4 conveyed by the conveying belt 23, when the sheet 4 passes through the photosensitive drum 31 and the transfer roller 24. Thus, each color toner image formed at each image forming section 30 is superposed with each other, and is then conveyed to a fixing unit 50.

The fixing unit 50 is provided at a rear side of the conveying belt 23. The fixing unit 50 includes a heat roller 51 and a pressure roller 52. The heat roller 51 has a heat source such as a halogen lamp, and is adapted to apply conveying force to the sheet while heating the toner. The pressure roller 52 is disposed on the opposite side of the sheet from the heat roller 51 for pressing the sheet against the heat roller 51. The sheet 4 carrying a color toner image is nipped between the heat roller 51 and the pressure roller 52 and is conveyed, whereupon the color toner image is thermally fixed to the sheet 4. Conveying rollers 53 are disposed downstream of the fixing unit 50 at a position diagonally above the fixing unit 50, and discharge rollers 54 are disposed downstream of the conveying rollers 53 to convey the sheet onto the discharge tray 5A.

Figure 2A:
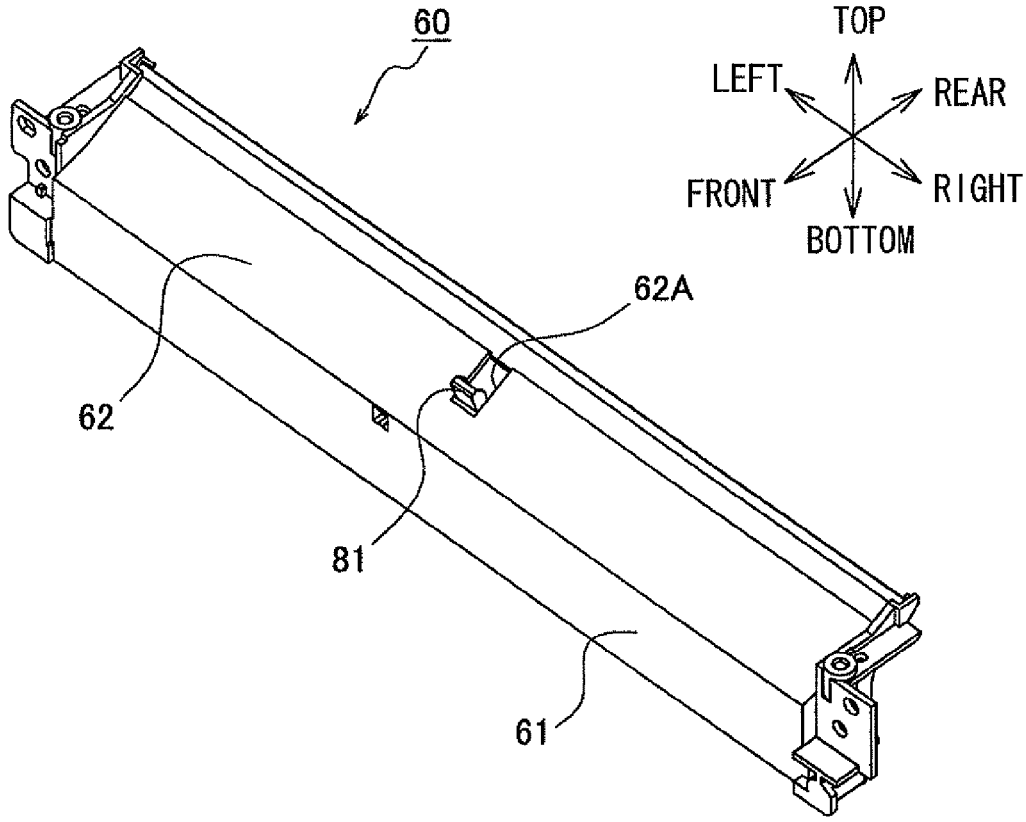
FIG. 2(A) is a perspective view of a front chute portion in the image forming device according to the first embodiment as viewed from a front side.
Figure 2B:
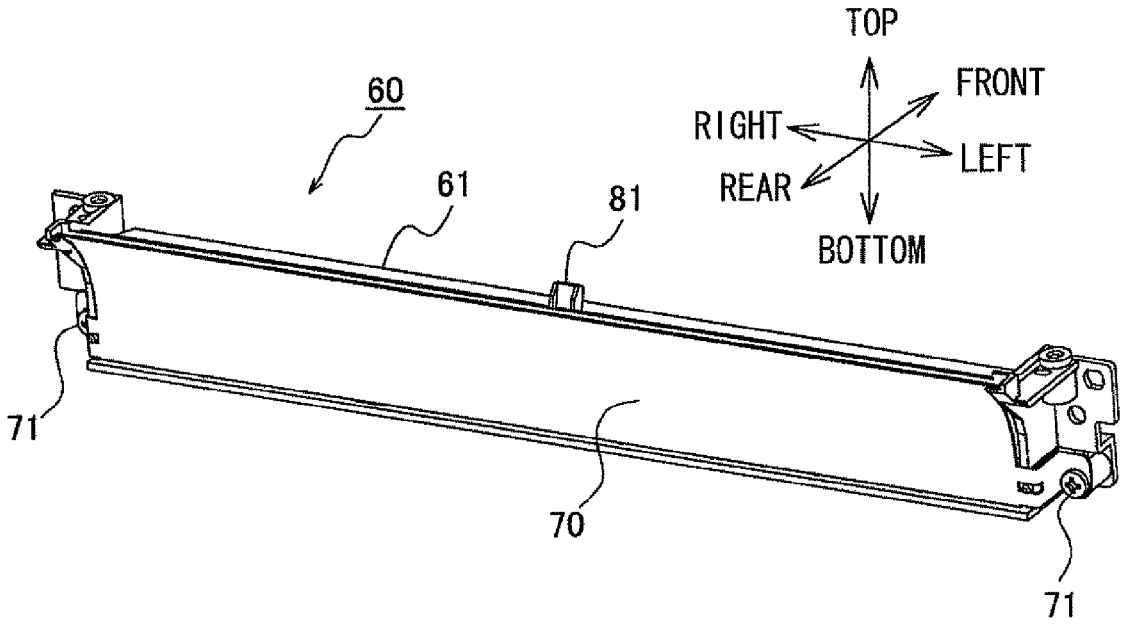
FIG. 2(B) is a perspective view of the front chute portion in the image forming device according to the first embodiment as viewed from a rear side.

A front chute portion 60 will be described. As shown in FIGS. 2(A) and 2(B), the front chute portion 60 includes a front chute cover 61 serving as a base component, and the chute member 70 positioned at a rear side of the front chute cover 61 and fixed thereto by screws 71. The chute member 70 has a major region gently curved along a sheet passage. The front chute cover 61 has an upper portion serving as a chute surface 62 for manual sheet insertion. The upper portion is formed with a rectangular opening 62A extending in the manual sheet inserting direction at a generally center portion of the upper portion in the widthwise direction of the sheet 4. An abutment portion 81 of an actuator 80 (described later) protrudingly extends through the opening 62A. The abutment portion 81 is pivotaly movable. A manual sheet insertion passage is defined between the chute surface 62 and a confronting surface 3A of the front cover 3. The manually inserted sheet 4 is then inserted between the register rollers 16 and 17. A distance (in a thickness direction of the sheet 4) between the confronting surface 3A and the chute surface 62 is gradually decreased toward the register rollers 16, 17. The register rollers 16, 17 are subjected to drive control each time the abutment portion 81 is pushed down by the manually inserted sheet 4.

Figure 3:
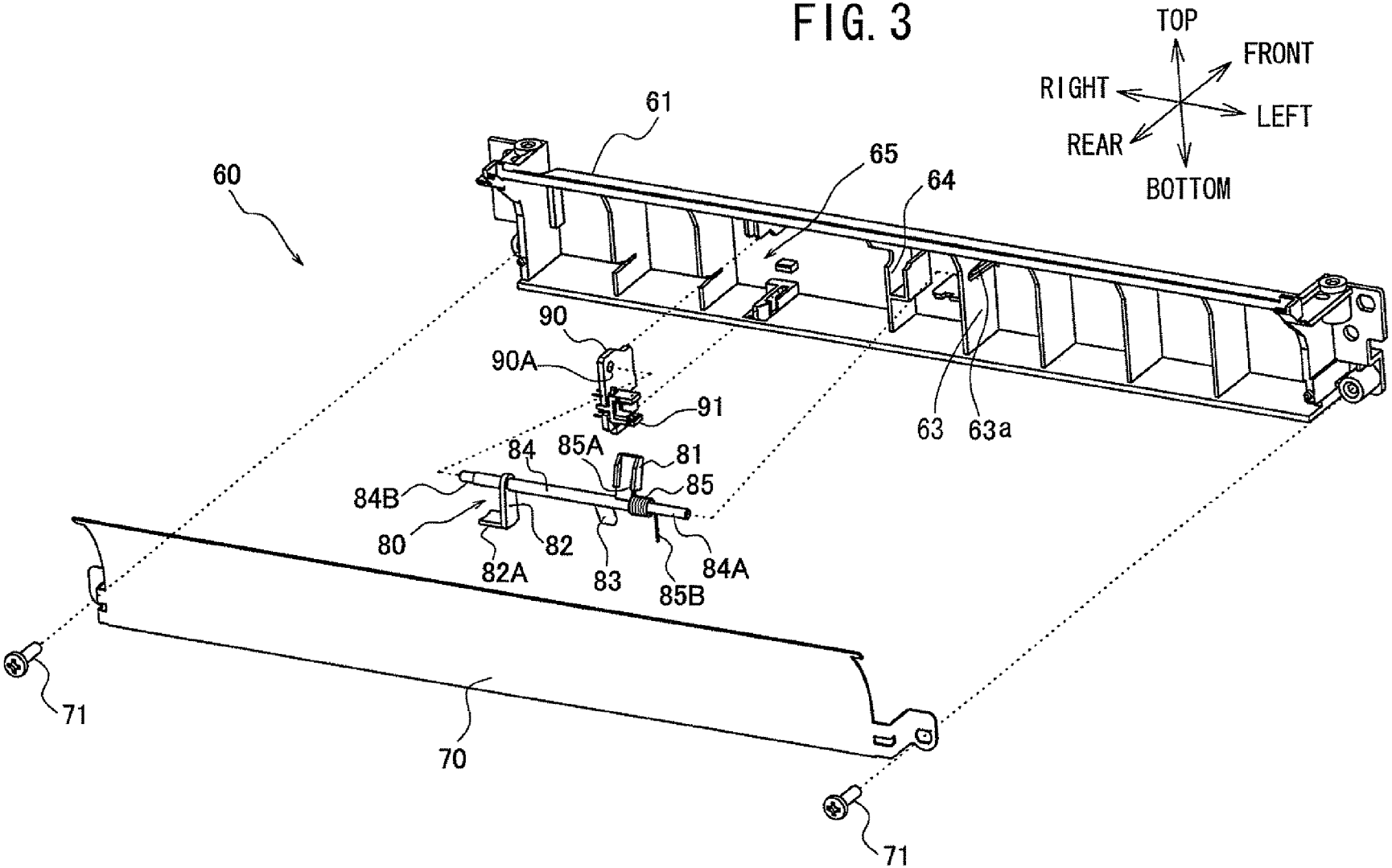
FIG. 3 is an exploded perspective view of the front chute portion in the image forming device according to the first embodiment.

As shown in FIG. 3, the cute cover 61 is of box shape with its rear side being open. The actuator 80 and a detection board 90 are installed in the cute cover 61. The actuator 80 includes a shaft 84, the abutment portion 81 extending from the shaft 84, an arm 82 extending from the shaft 84 and having a free end provided with a light shielding plate 82A functioning as a detected portion, and a positioning segment 83 extending from the shaft 84 for positioning the actuator 80. The abutment portion 81, the arm 82, and the positioning segment 83 are integral with the shaft 84. The detection board 90 is constituted by a known print circuit board and is provided with a photo-interrupter 91 functioning as a detecting element.

For supporting the actuator 80 and the detection board 90, a shaft support 63, a position regulating portion 64, and a board support 65 are provided in the front chute cover 61. The shaft support 63 is adapted for supporting one end portion 84A of the shaft 84. The position regulating portion 64 is adapted to receive therein the positioning segment 83. The board support 65 is adapted to be assembled with the detection board 90.

Figure 4A:
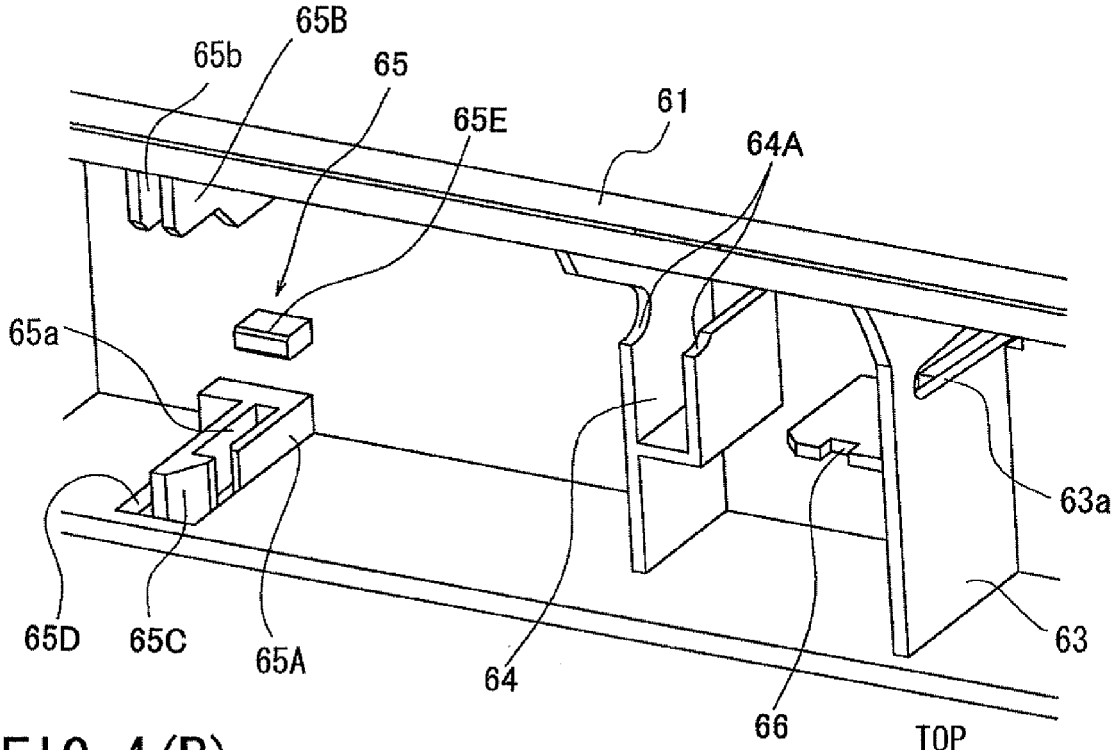
FIG. 4(A) is an enlarged partial perspective view of an internal center portion of a chute cover in the image forming device according to the first embodiment.
Figure 4B:
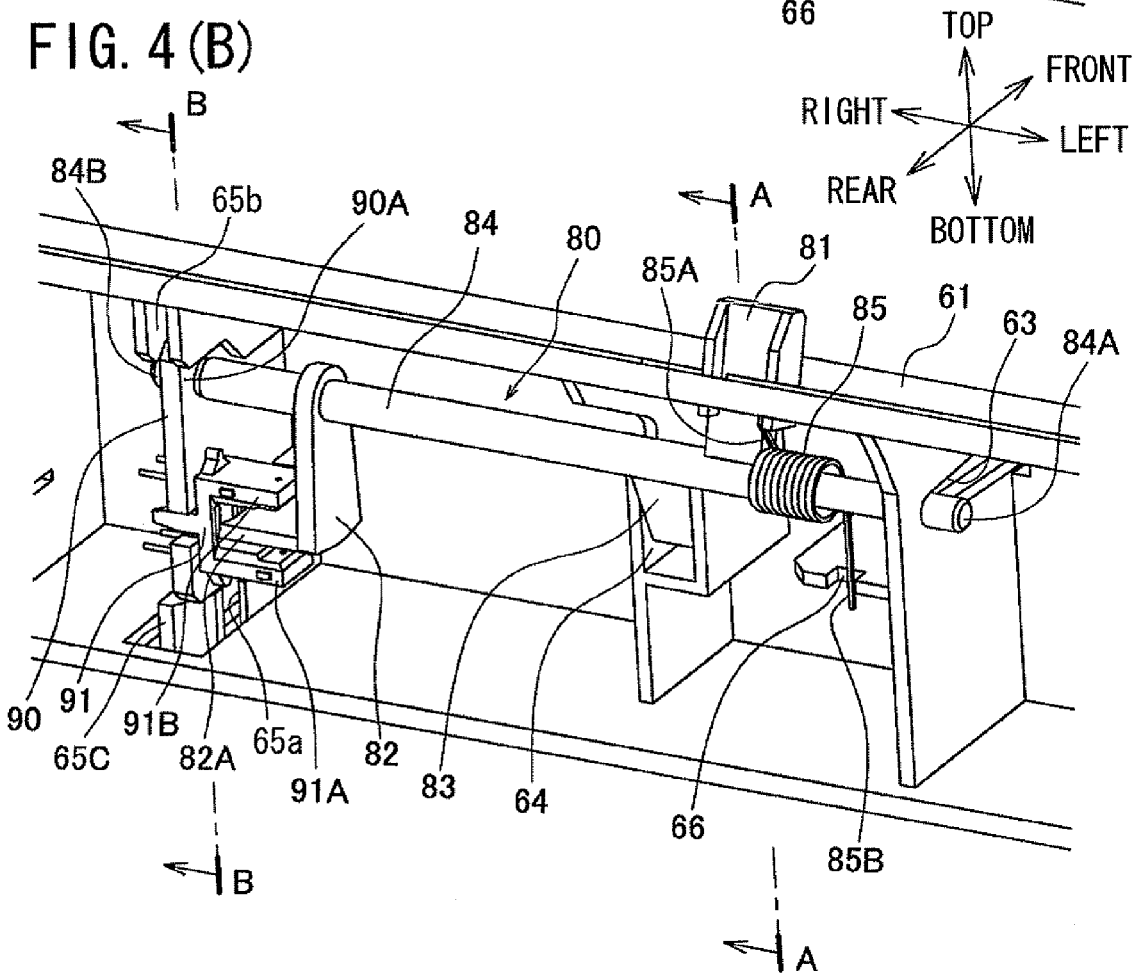
FIG. 4(B) is an enlarged partial perspective view of the internal center portion of the cute cover assembled with an actuator and a detection board in the image forming device according to the first embodiment.

More specifically, as shown in FIGS. 4(A) and 4(B), the shaft support 63 is formed with an elongated slot 63 extending in frontward/rearward direction for rotatably supporting one end portion 84A of the shaft 84. The elongated slot 63 can facilitate insertion of the one end portion 84A into the slot 63 for assembly. The position regulating portion 64 is formed with an arcuate notched portion 64A on which the shaft 84 is rotatably supported. The one end portion 84A of the shaft 84 is rotatably positioned at a front end side of the elongated slot 63*a* after the shaft 84 is supported on the notched portion 64A.

The position regulating portion 64 is in the form of U-shape in order to receive the positioning segment 83. The arcuate notched portion 64A is positioned at the open top end of the position regulating portion 64. Displacement of the positioning segment 63 in the axial direction of the shaft 84 is restricted by the position regulating portion 64, so that the actuator 80 can be positioned at a given position in the widthwise direction of the sheet.

The detection board 90 is formed with a bearing hole 90A rotatably supporting another end portion 84B of the shaft 84. The other end portion 84B extends throughout the bearing hole 90A. The other end portion 84B has a diameter smaller than that of the remaining portion of the shaft 84. The light shielding plate 82A is provided by bending a free end portion of the arm 82 into L shape. The photo-interrupter 91 includes a light emitting portion 91A and a light receiving portion 91B in confrontation therewith. The light shielding plate 82A can be entered into a space between the light emitting portion 91A and the light receiving portion 91B, and retractable from the space.

Figure 5B:
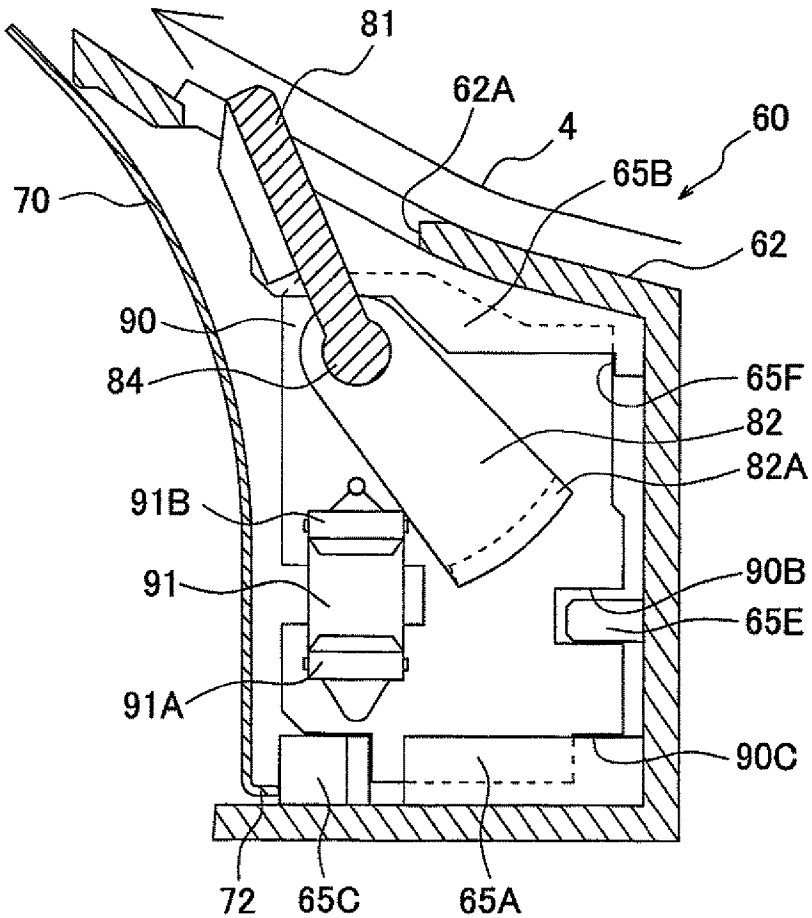
FIGS. 5(A) and 5(B) are cross-sectional views taken along the line A-A in FIG. 4(B)
Figure 5A:
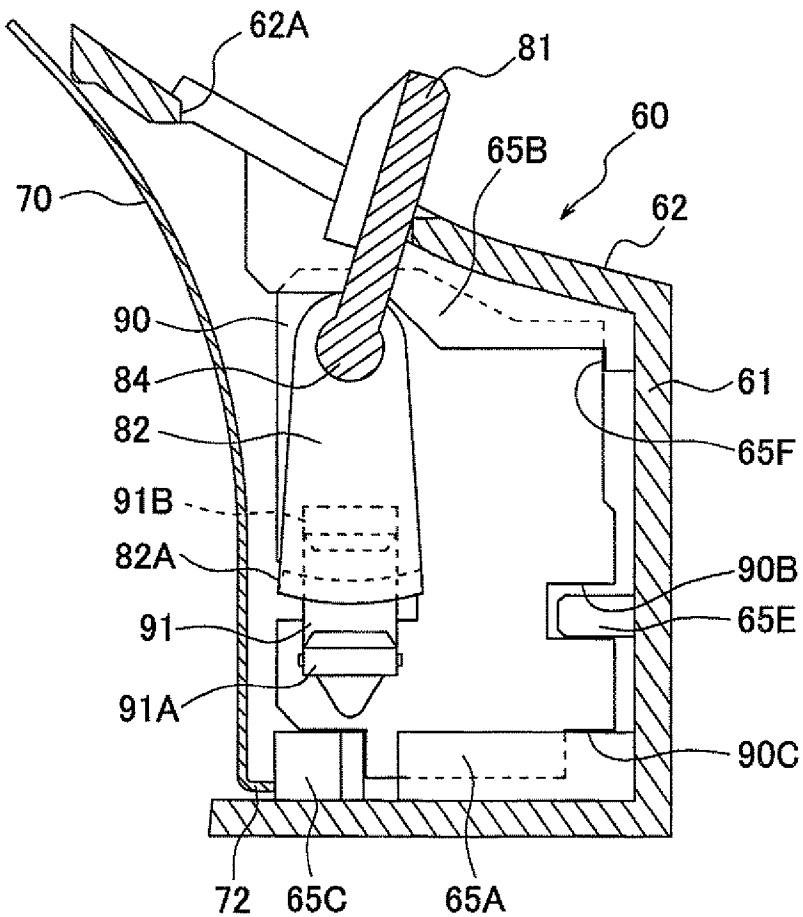

A spring seat 66 is provided in the front chute cover 61, and a torsion spring 85 is disposed over the shaft 84. The torsion spring 85 has one end 85A seated on the abutment portion, and another end 85B seated on the spring seat 85, so that the abutment portion 81 is biased to a position shown in FIG. 4(B). More specifically, as shown in FIGS. 4(B) and 5(A), the abutment portion 81 is in abutment with the front edge of the rectangular opening 62A by the biasing force of the torsion spring 85. In this state, the light shielding plate 82A is at its shut-off position shutting off an optical passage between the light emitting portion 91A and the light receiving portion 91B. If the sheet 4 is inserted through the manual insertion tray 18, the leading edge of the sheet 4 pushes the abutment portion 81 to angularly move the abutment portion 81 as shown in FIG. 5(B) against the biasing force of the torsion spring 85. As a result, light from the light emitting portion 91A is received by the light receiving portion 91B to generate a detection signal, whereupon driving control to the register rollers 16, 17 will be executed by a controller (not shown).

Figure 6:
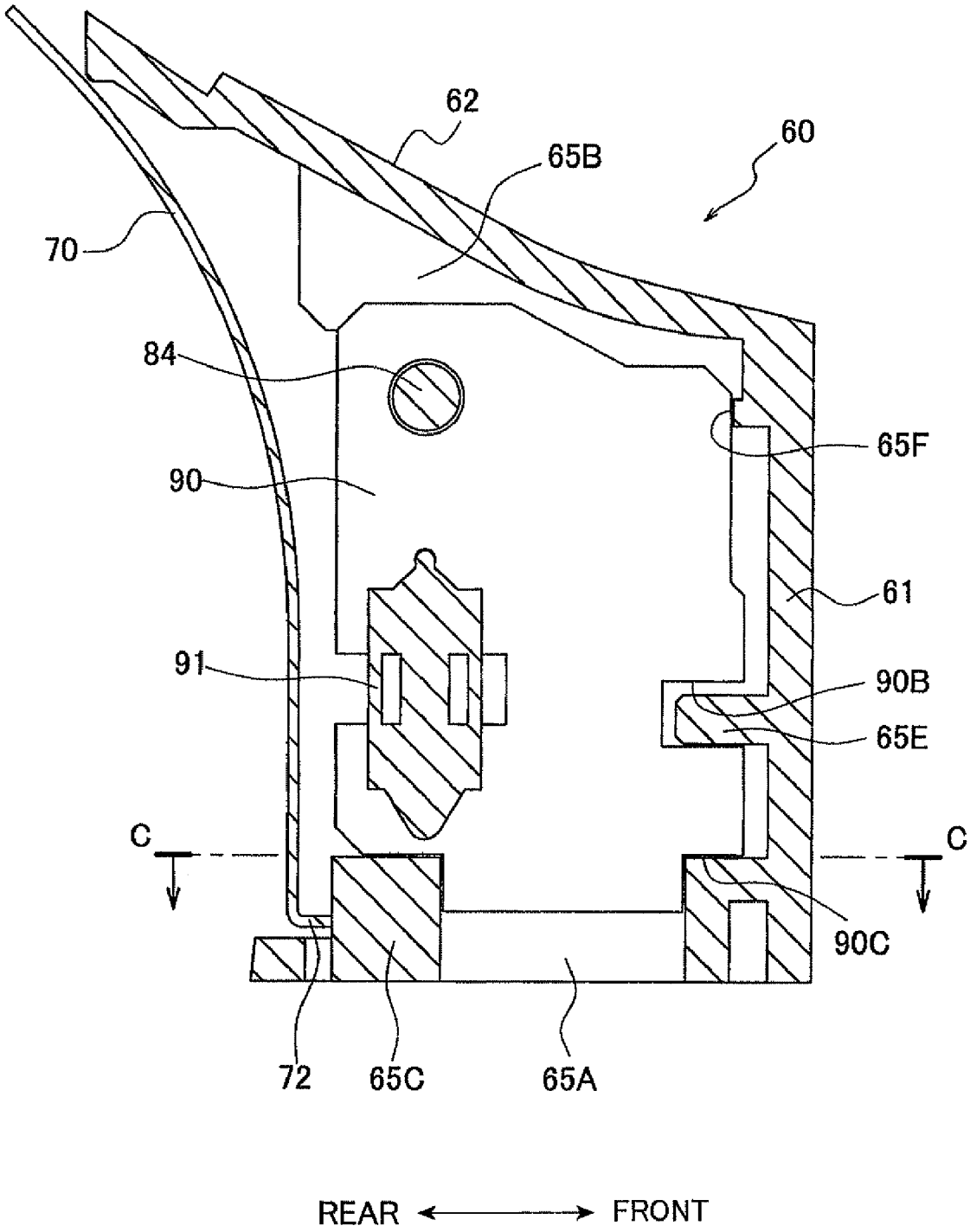
FIG. 6 is a cross-sectional view taken along the line B-B in FIG. 4(B)

Next, details of the board support 65 will be described with reference to FIGS. 4(A) and 6 where the positioning segment 83 and the position regulating portion 64 are omitted for simplicity. The board support 65 includes a lower retainer 65A, an upper retainer 65B, a hook 65C, an engagement rib 65E, and a stop rib 65F. The lower and upper retainers 65A and 65B are formed with slits 65*a* and 65*b*, respectively for nippingly holding lower edge and upper edge portions of the detection board 90, respectively. The hook 65C is integral with the lower retainer 65A for preventing the lower edge of the detection board 90 from being disengaged from the slit 65*a*. The chute cover 61 has a lower plate section formed with a through-hole or groove 65D that allows the hook 65C to be resiliently bent. The chute cover 61 has a front plate section provided with the stop ring 65F and the engagement rig 65E extending in a horizontal direction.

The detection board 90 is subjected to positioning in a lateral direction (widthwise direction of the sheet) upon engagement with the slits 65*a* and 65*b*. Further, the detection board 90 is formed with a front recess 90B engageable with the engagement rib 65E, and the detection board 90 is also formed with a front/bottom recess 90C engageable with an upper front surface of the lower retainer 65A. Thus, the detection board is subjected to positioning in a vertical direction. Further, the front edge of the detection board 90 is abuttable on the stop rib 65F to prevent the detection board 90 from being angularly moved. Further, the lower front edge and lower rear edge of the detection board 90 are in contact with the front end of the lower slit 65*a* and the hook 65C, respectively, to fix the position of the detection board 90 in the frontward/rearward direction.

The chute member 70 made from a metal has a lower end portion provided with a bent portion 72 provided by press-forming. The bent portion 72 is adapted for preventing the detection board 90 from being released from the chute cover 61 if the hook 65C is accidentally bent due to application of external force to the hook 65, for example, when user touches the hook 65C.

Figure 7A:
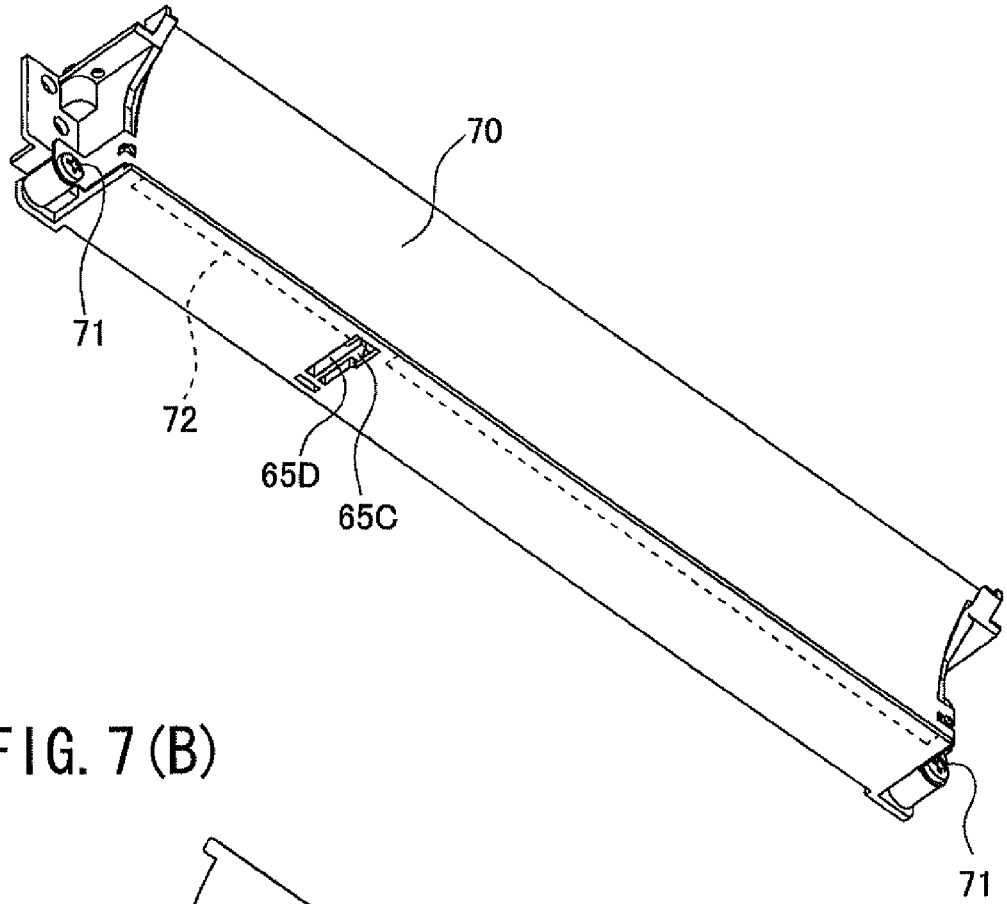
FIG. 7(A) is a perspective view of the front chute portion as viewed from a lower rear side.
Figure 7B:
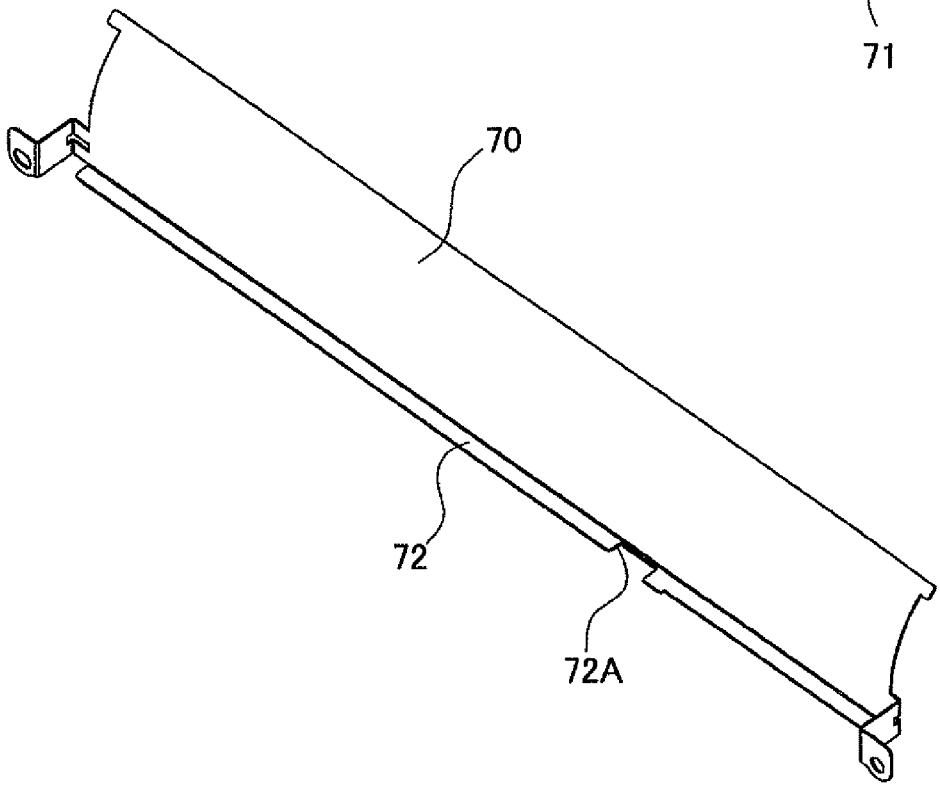
FIG. 7(B) is a perspective view of a metal plate chute as viewed from an upper front side.
Figure 8:
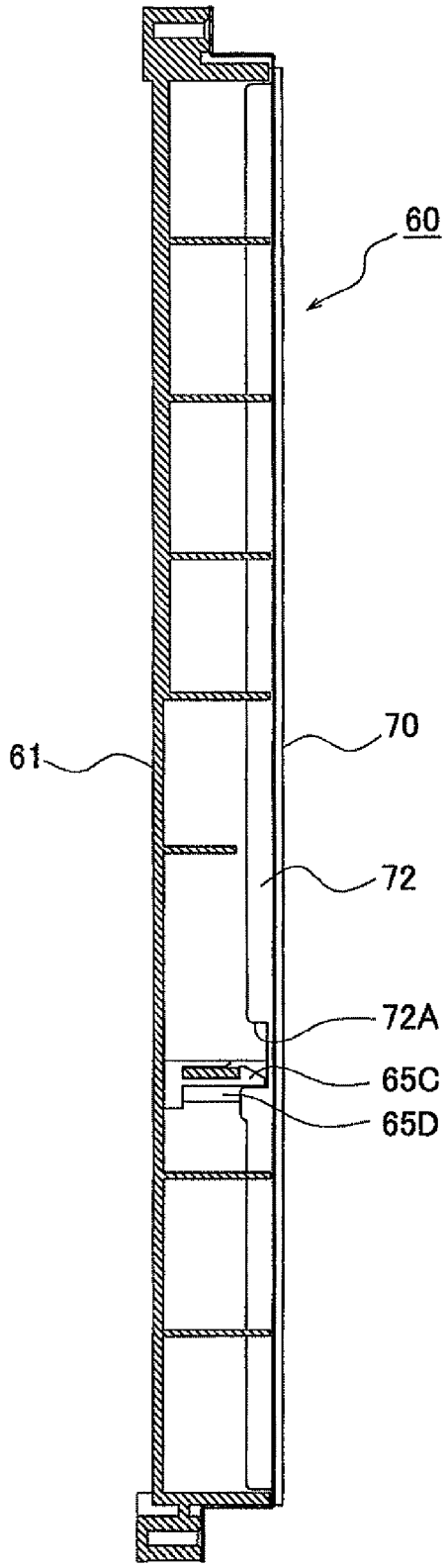
FIG. 8 is a cross-sectional view taken along the line C-C in FIG. 6.

As shown in FIG. 7(B), the bent portion 72 is formed with a rectangular recess 72A. The bent portion 72 is positioned immediately above the bottom wall section of the chute cover 61 when the chute member 70 is fixed to the chute cover 61 as shown in FIGS. 6, 7(A), and 8. In this case, the hook 65C is engaged with the rectangular recess 72A as shown in FIG. 8, so that the hook 65C becomes immovable or un-deformable within the through-hole 65D.

Upon assembly of the chute member 70 to the chute cover 61 to provide the front chute portion 60, disengagement of the detection board 90 due to bending of the hook 65C can be prevented, since the free movement or free deformation of the hook 65C is prevented by the rectangular recess 72A. Accordingly, the positioning segment 83 of the actuator 80 can be stably positioned in the position regulating portion 64.

For the attachment of the actuator 80, the one end portion 84A of the shaft 84 is firstly inserted into the elongated slot 63*a*, and then, the other end portion 84B of the shaft 84 is inserted into the bearing hole 90A of the detection board 90. Thereafter, the detection board 90 is assembled to the front chute cover 61. Alternatively, the detection board 90 is firstly assembled to the front chute cover 61, and then the shaft 84 is moved leftward in FIG. 3 while the one end portion 84A is inserted into the elongated slot 63*a*. Thereafter, the shaft 84 is moved rightward in FIG. 3 to insert the other end portion 84B into the bearing hole 90A.

Since the other end portion 84B of the shaft 84 is directly rotatably supported by the detection board 90, a simple construction can result and detection accuracy can be improved in spite of the employment of an ordinary photo-interrupter 91 as the detecting element. To be more specific, with the above arrangement, error causes or error parameters are only limited to relative positional error between the bearing hole 90A and the photo-interrupter 91 on the detection board 90, dimensional error or assembly error between the bearing hole 90A and the other end portion 84B of the shaft, and relative positional error between the light shielding plate 82A and the shaft 84. In other words, attachment error of the detection board 90 relative to the chute cover 61 could not be the error parameter, thereby improving detection accuracy. Accordingly, sufficient detection accuracy can be provided even though the pivotally moving angle of the abutment portion 81 is designed to be small. Thus, enhanced design freedom can be obtained.

Further, since the one end portion 84A of the shaft 84 extends through the elongated slot 63*a* and the other end portion 84B of the shaft 84 extends through the bearing hole 90A, the other end portion 84B can follow the detection board 90 even if the detection board 90 is displaced or the detection board 90 is accidentally disengaged from the board support 65. Accordingly, incapability of detection of the pivotal motion of the abutment portion 81 can be restrained.

Figure 9:
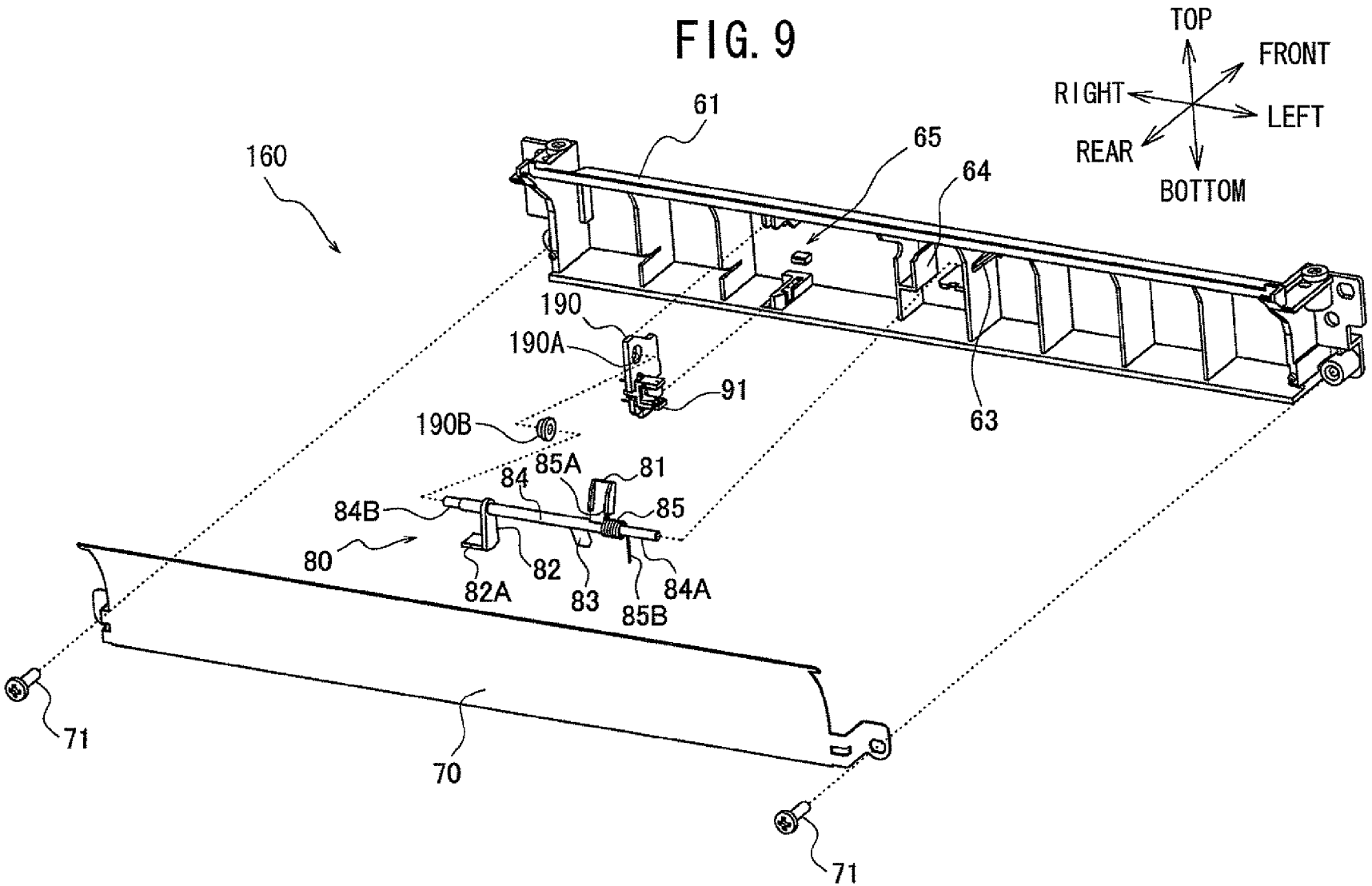
FIG. 9 is an exploded perspective view showing a front chute portion in an image forming device according to a second embodiment of the present invention.
Figure 10:
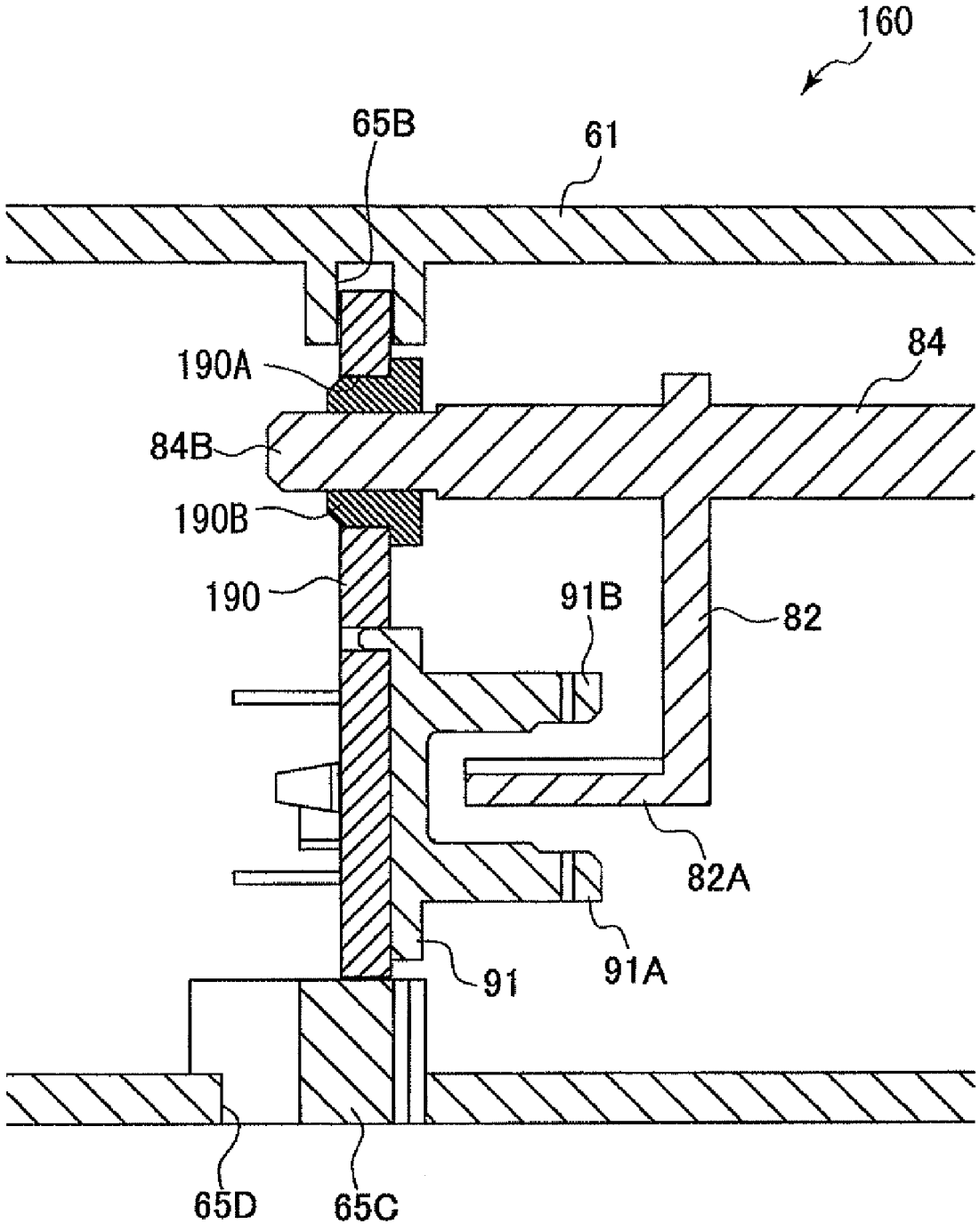
FIG. 10 is a cross-sectional view of the front chute portion according to the second embodiment.
Figure 11:
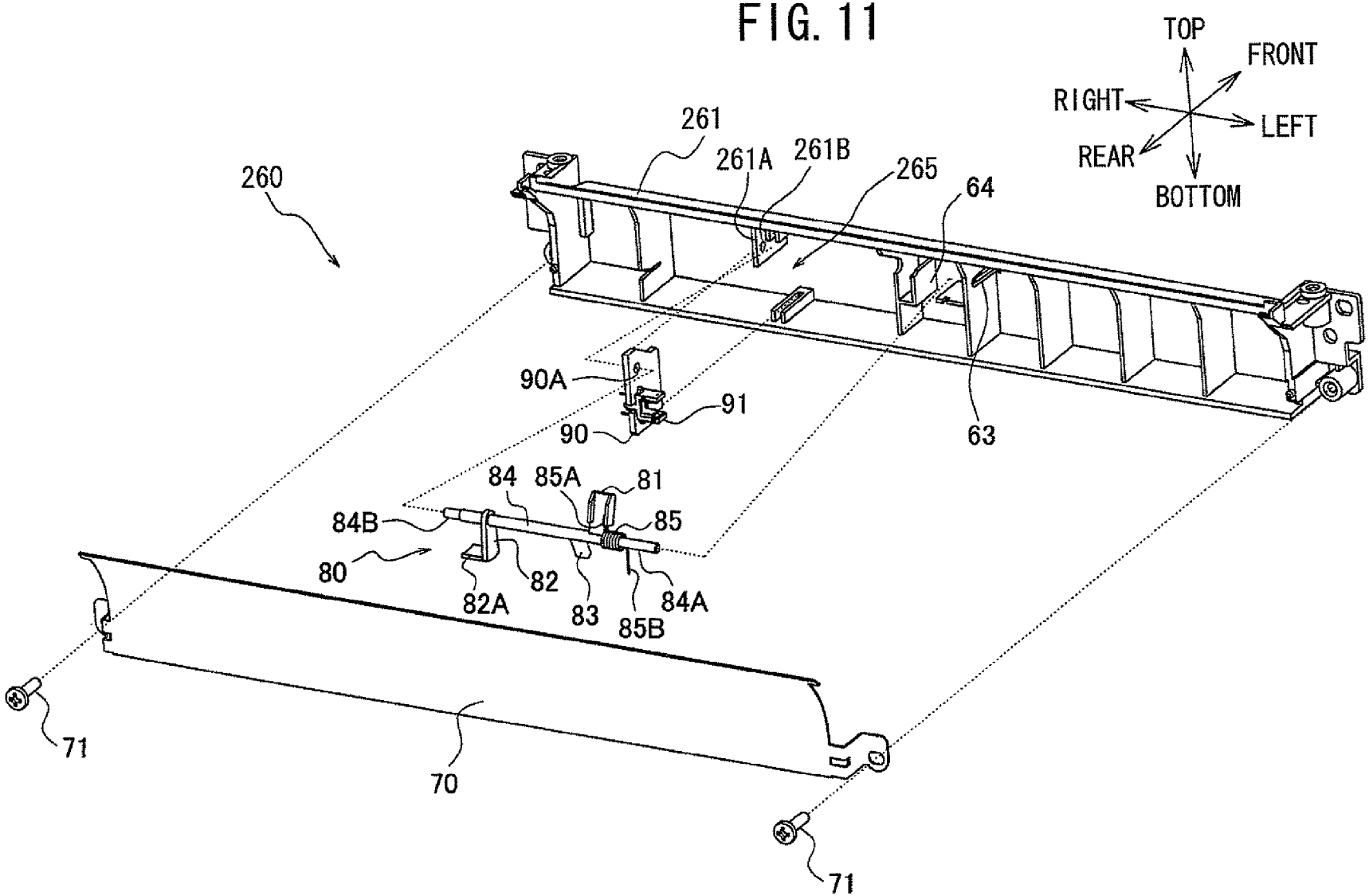
FIG. 11 is an exploded perspective view showing a front chute portion in an image forming device according to a third embodiment of the present invention.
Figure 12A:
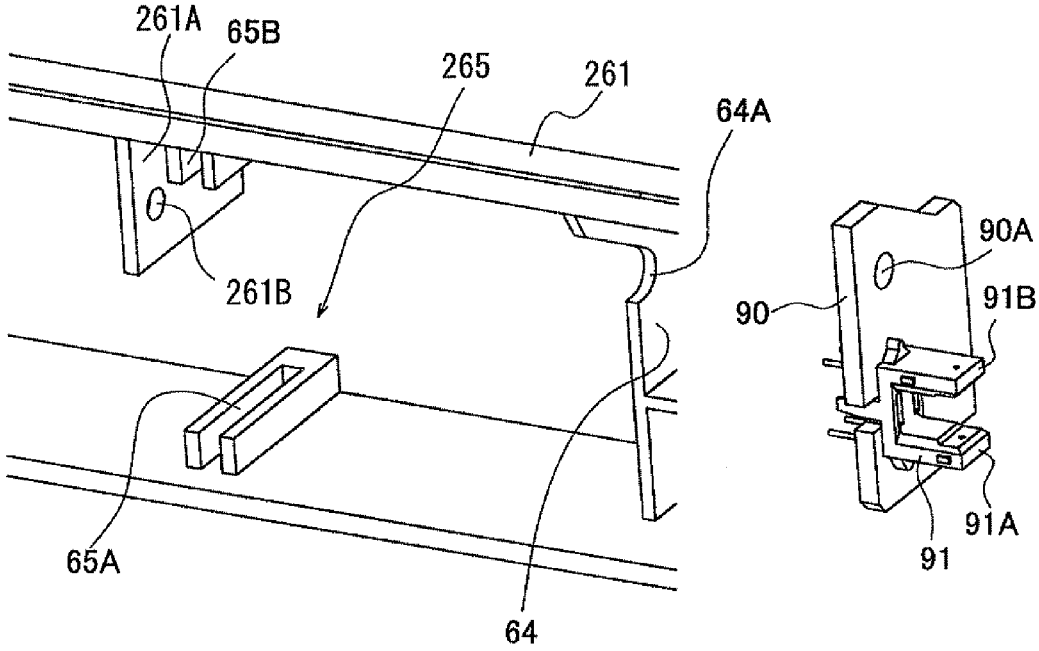
FIGS. 12(A) and 12(B) are partial perspective views of the front chute portion according to the third embodiment.
Figure 12B:
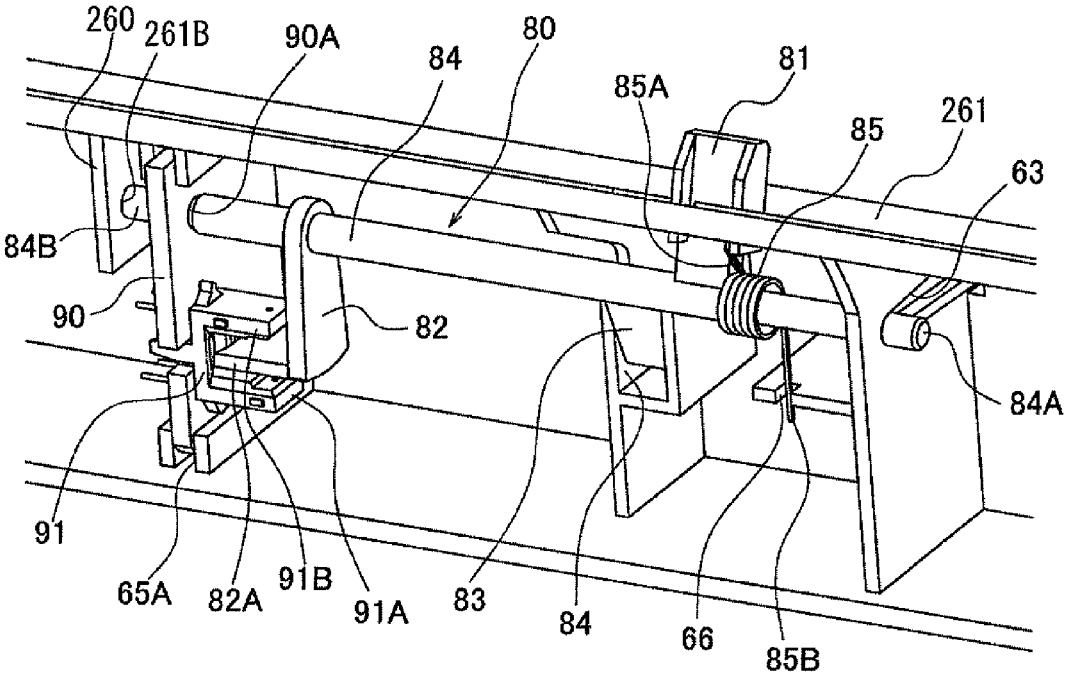

An image forming device according to a second embodiment of the present invention will be described with reference to FIGS. 9 and 10. The second embodiment pertains to a modification to the first embodiment with respect to the front chute portion. Incidentally, FIG. 10 is a cross-sectional view of a front chute portion 160 taken along a plane passing through an axial center of the shaft 84. In the second embodiment, a separate bearing sleeve 190B made from a synthetic resin is forcibly fitted with the bearing hole 190A of a detection board 190, and the other end portion 84B of the shaft 84 is rotatably supported by the bearing sleeve 190.

The detection board 190 has its surface roughness coarser than that of an ordinary available bearing component. Unless the bearing sleeve 190B is provided, the other end portion 84B is in direct rotational sliding contact with the bearing hole 190A. If the rotation force applied to the shaft 84 is sufficient, the coarse surface roughness is negligible. However, if sufficient rotation force is not applied to the shaft 84, the rotational sliding resistance will occur due to the coarse surface roughness at the bearing hole 190A. In order to reduce friction, the bearing sleeve 190B made from the synthetic resin (low friction material) is fitted in the bearing hole 190A. As a result, sliding resistance can be reduced to enhance detection.

FIGS. 11 through 13(B) show a front chute portion 260 in an image forming device according to a third embodiment of the present invention. A bearing plate 261A extends from an inner surface of a chute cover 261 at right side of the upper retainer 65B. The bearing plate 261A is formed with a bearing hole 261B for rotatably supporting the other end portion 84B of the shaft 84 in addition to the rotatable support of the other end portion 84B by the bearing hole 90A. The bearing hole 261B has an inner diameter substantially equal to that of the bearing hole 90A so that the smaller diameter portion, i.e., the other end portion 84B of the shaft can be rotatably supported.

According to the third embodiment, smooth angular rotation of the shaft 84 can result, since both one and other end portions 84A and 84B are supported by the chute cover 261. Further, relative positional accuracy between the detection board 90 and the actuator 80, and between the actuator 80 and the chute cover 261 can be enhanced, thereby enhancing positional accuracy between the chute cover 261 and the detection board 90.

Figure 13B:
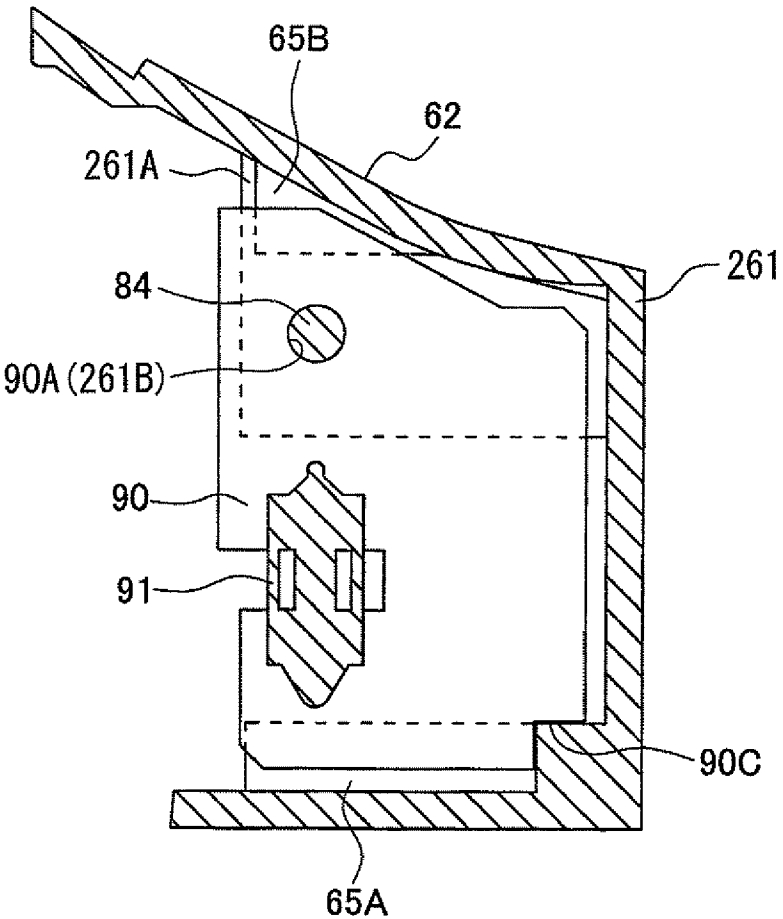
FIG. 13(B) is a cross-sectional view taken along the line D-D in FIG. 13(A)
Figure 13A:
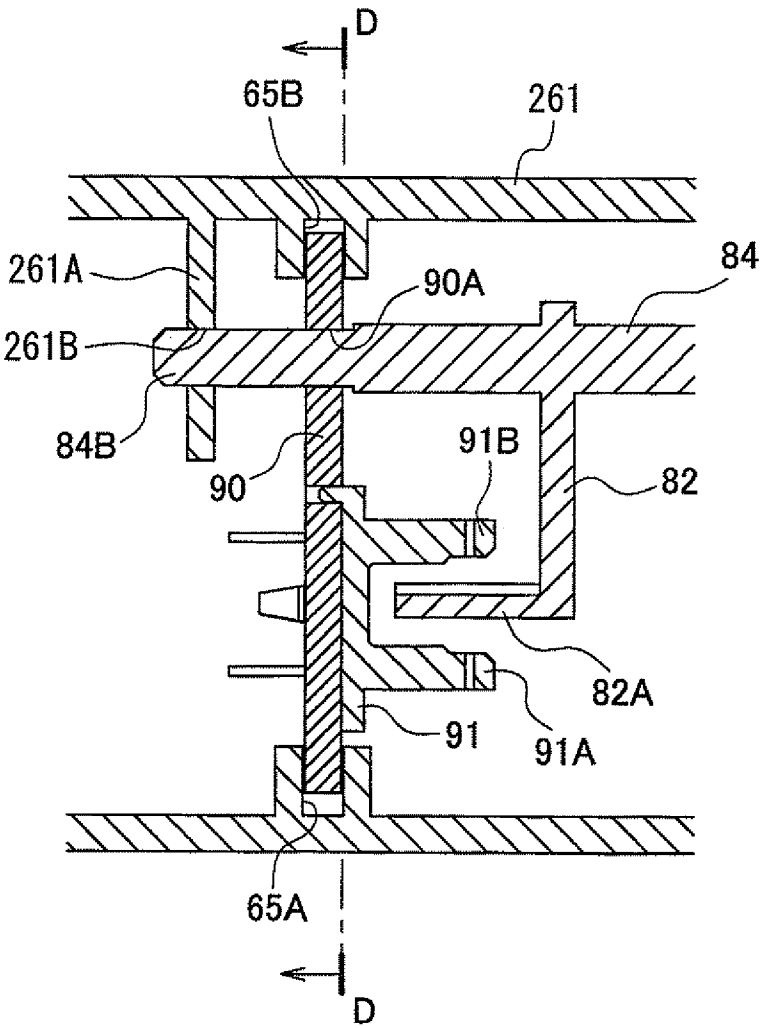
FIG. 13(A) is a cross-sectional view showing an essential portion of the front chute portion according to the third embodiment.

Moreover, the detection board 90 can be subjected to positioning relative to the chute cover 261 by the extension of the shaft 84 through the bearing holes 90A and 261B. With this arrangement, an entire arrangement of a board support 265 can be simplified. More specifically, the hook 65C can be dispensed with, since disengagement of the detection board 90 from the chute cover 261 can be avoided because of the extension of the shaft 84 through the bearing holes 90A and 261B. To this effect, the through-hole 65D and the rectangular recess 72A are also dispensed with. Further, as shown in FIG. 13(B), angular displacement and vertical displacement of the detection board 90 can be prevented by the engagement of the front/bottom recess 90C with the front portion of the lower retainer 65A. Therefore, the front recess 90B, engagement rib 65E and stop rib 65F can be dispensed with. Incidentally, the detection board 90 can be positioned at a given lateral position by the slits 65*a*, 65*b* as in the foregoing embodiments.

For the attachment of the actuator 80, the one end portion 84A of the shaft 84 is firstly inserted into the elongated slot 63*a*, and then, the other end portion 84B of the shaft 84 is inserted into the bearing hole 90A of the detection board 90. Thereafter, the detection board 90 is assembled to the front chute cover 261. Then, the shaft 84 is axially displaced toward the other end portion 84B so as to allow the other end portion 84B to pass through the bearing hole 261B of the bearing plate 261A. Alternatively, the detection board 90 is firstly assembled to the front chute cover 261, and then the shaft 84 is moved leftward in FIG. 12(B) while the one end portion 84A is inserted into the elongated slot 63*a*. Thereafter, the shaft 84 is moved rightward in FIG. 12(B) to insert the other end portion 84B into the bearing holes 90A and 261B.

Figure 14:
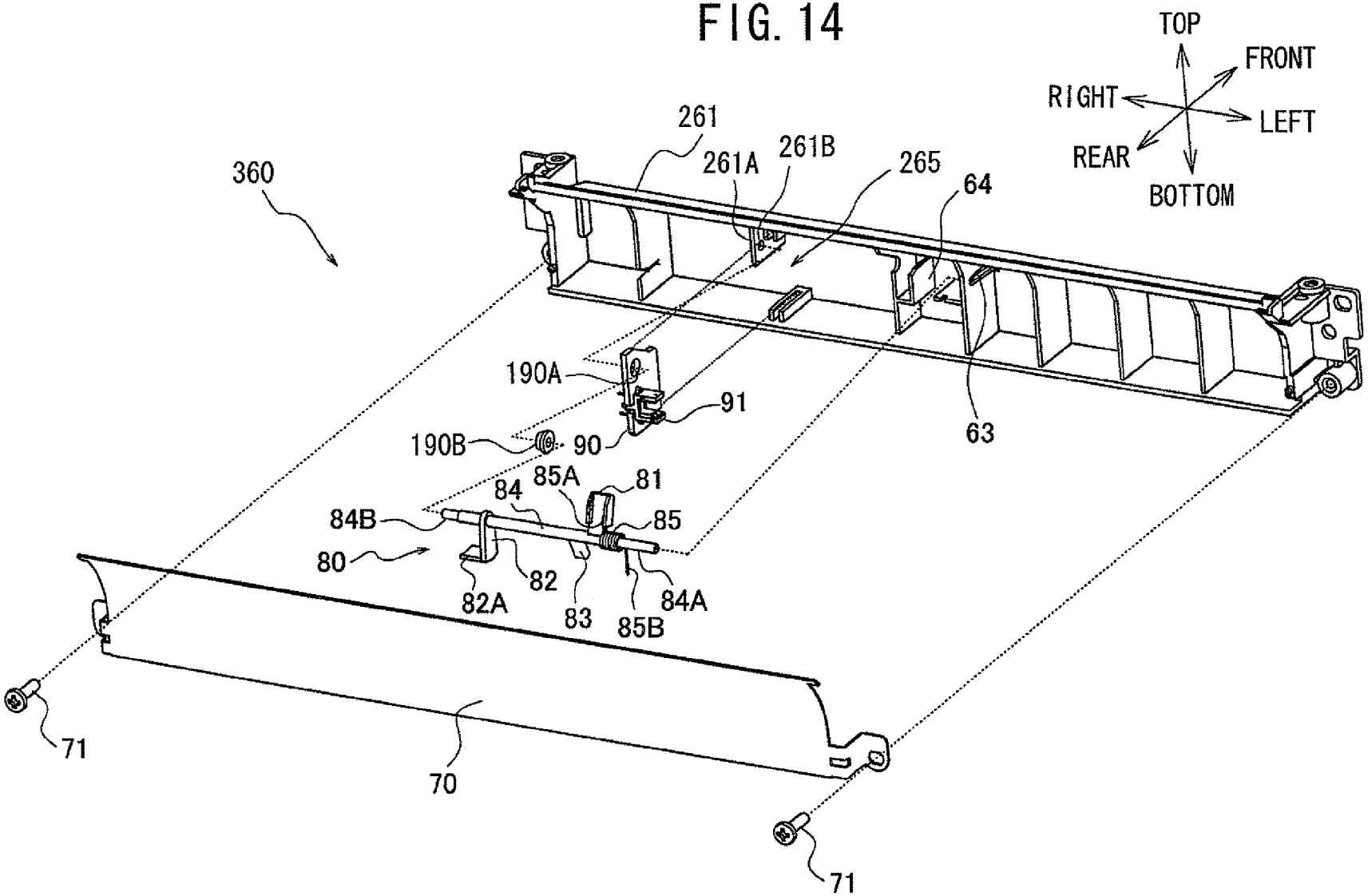
FIG. 14 is an exploded perspective view showing a front chute portion in an image forming device according to a fourth embodiment of the present invention.
Figure 15:
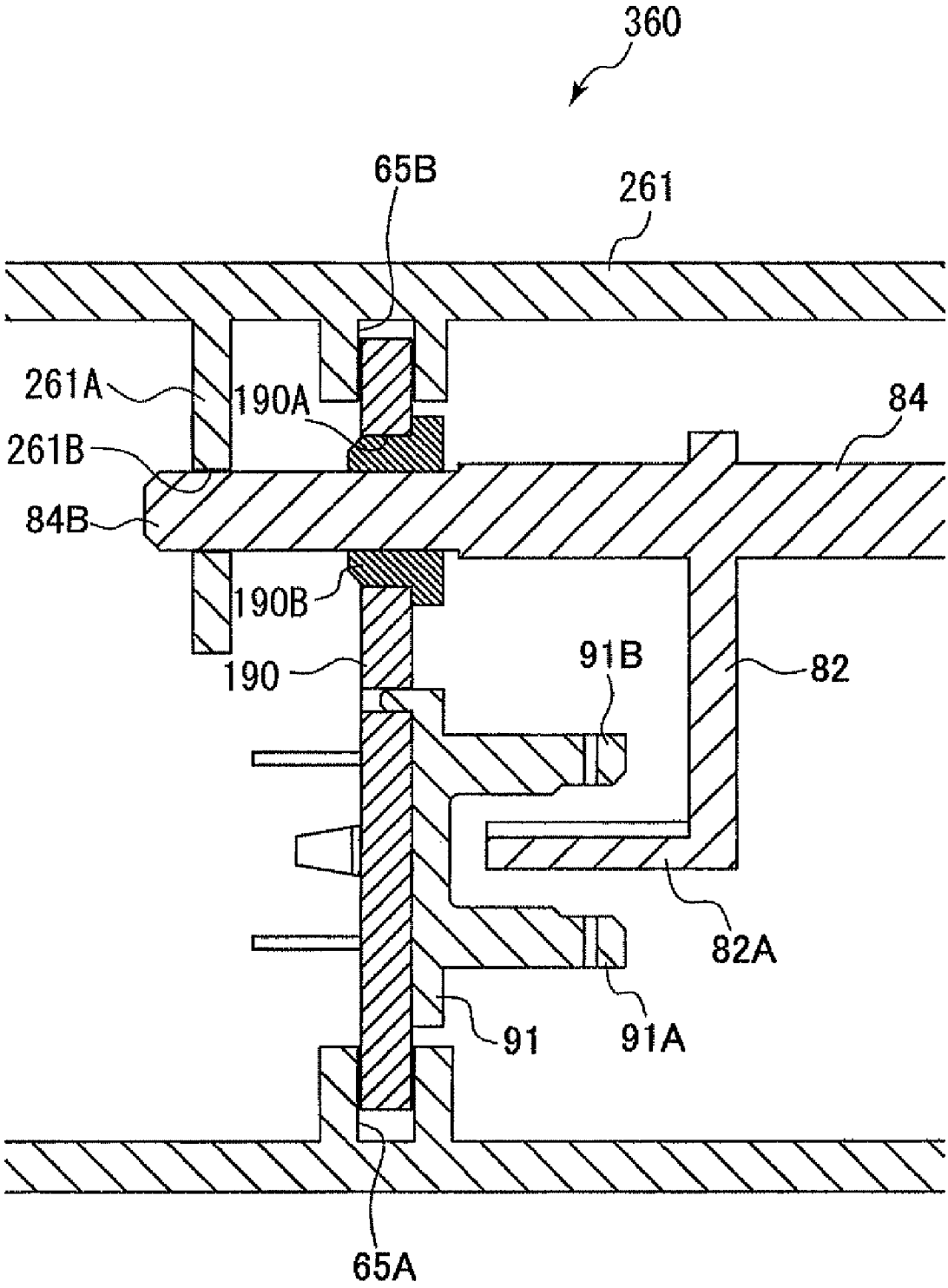
FIG. 15 is a cross-sectional view showing an essential portion of the front chute portion according to the fourth embodiment.
Figure 16:
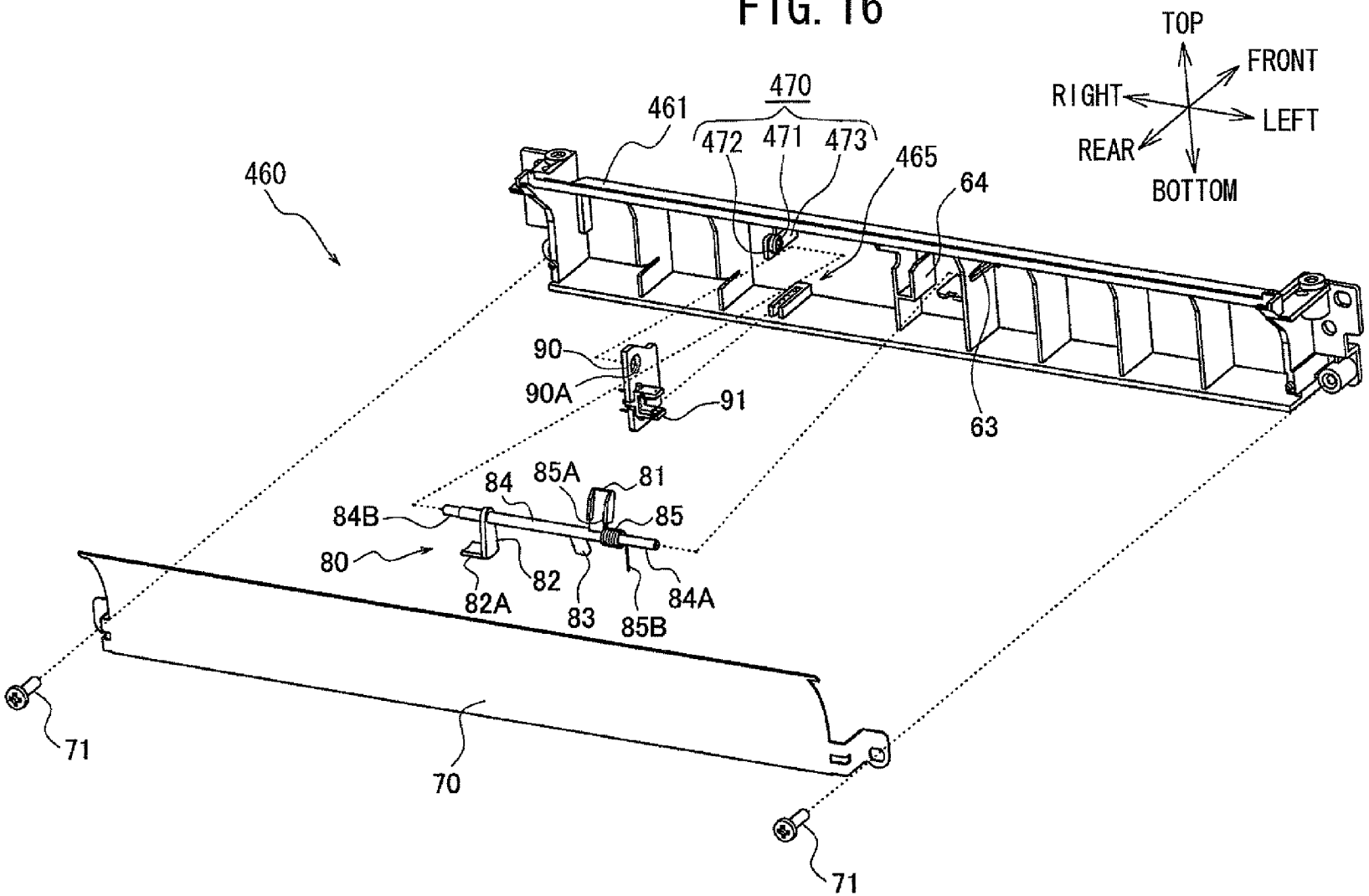
FIG. 16 is an exploded perspective view showing a front chute portion in an image forming device according to a fifth embodiment of the present invention.
Figure 17A:
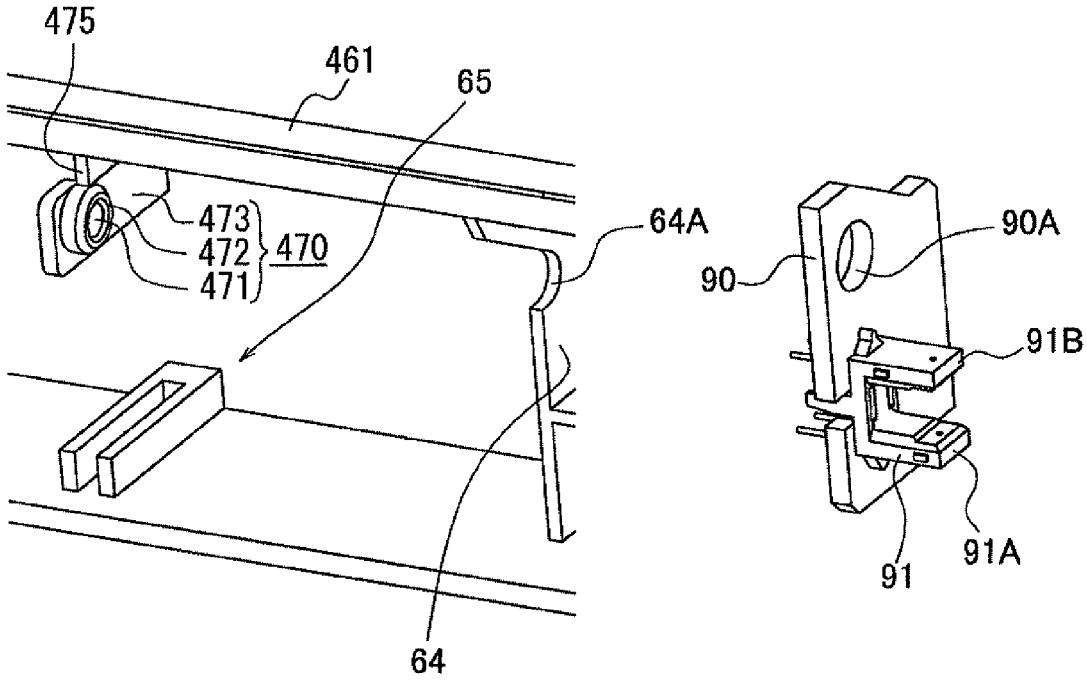
FIGS. 17(A) and 17(B) are partial perspective views of the front chute portion according to the fifth embodiment.
Figure 17B:
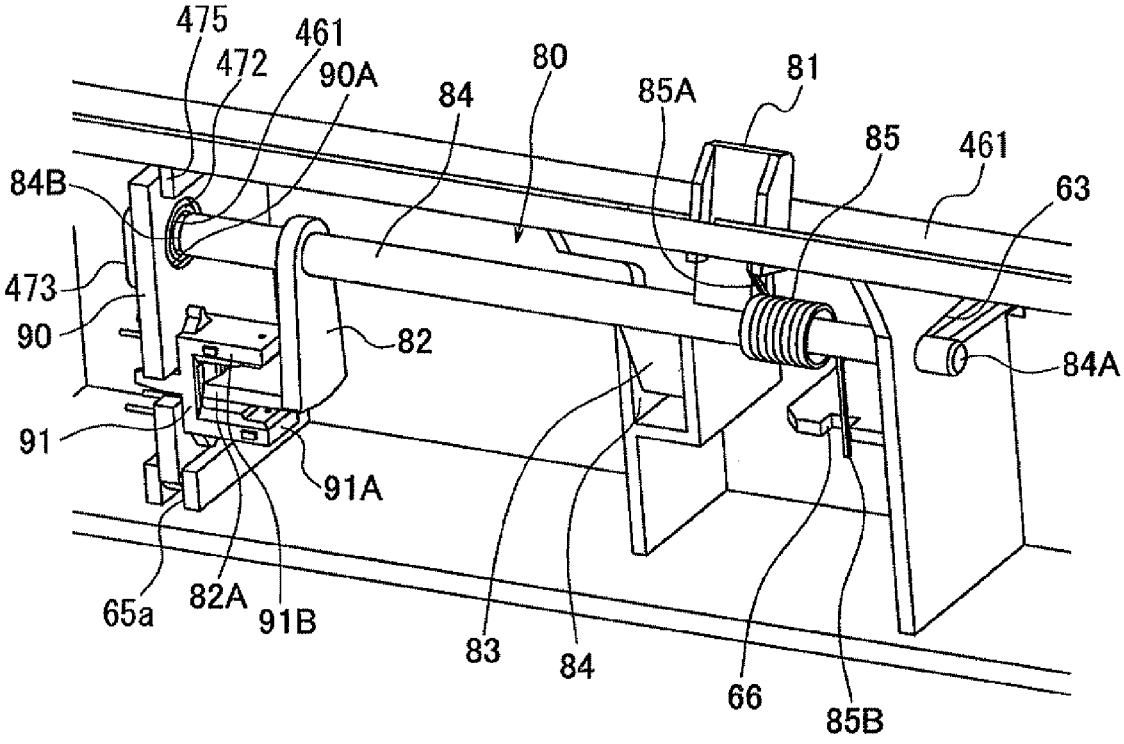
Figure 18B:
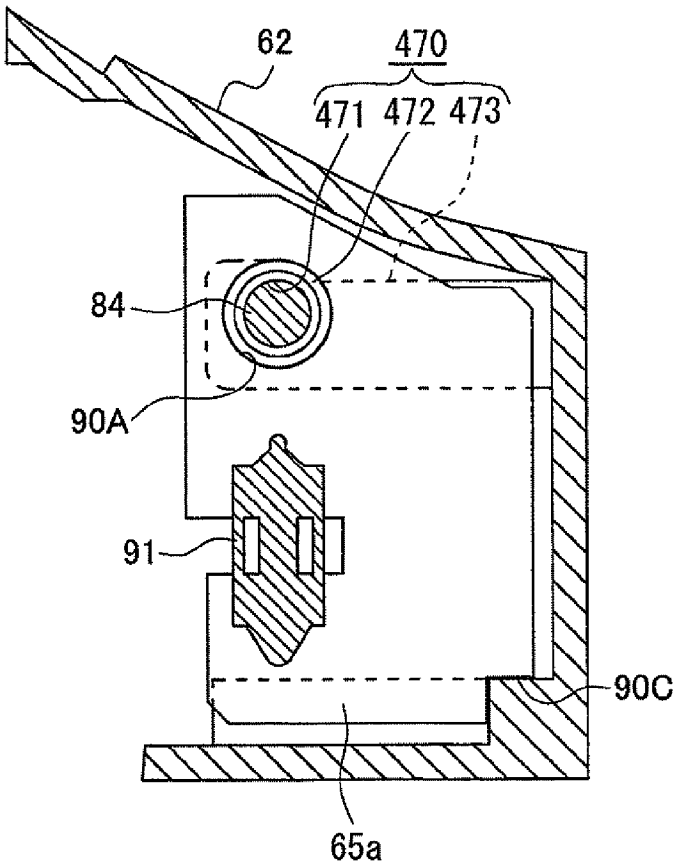
FIG. 18(B) is a cross-sectional view taken along the line E-E in FIG. 18(A)
Figure 18A:
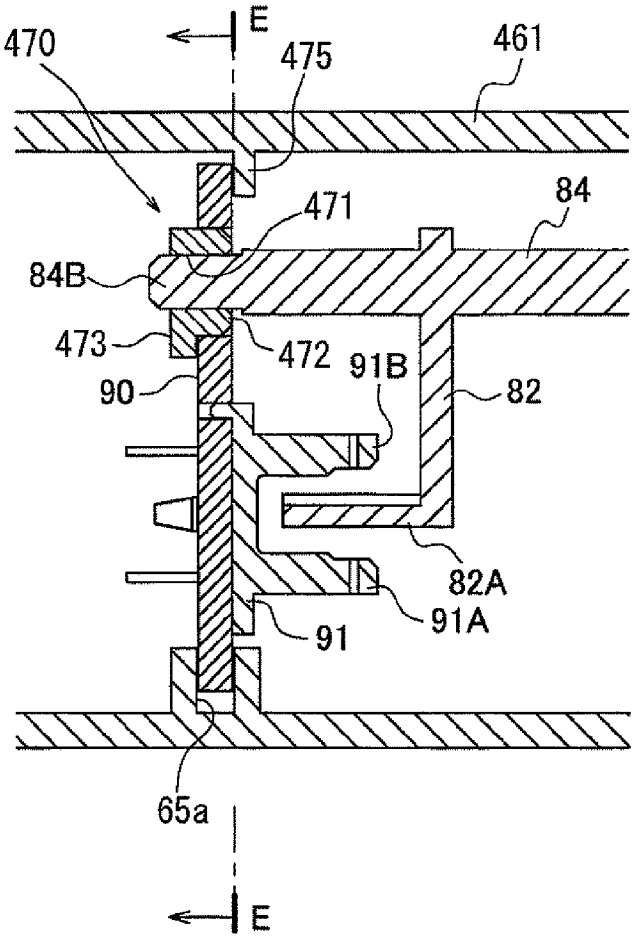
FIG. 18(A) is a cross-sectional view showing an essential portion of the front chute portion according to the fifth embodiment.

FIGS. 14 and 15 show a front chute portion 360 in an image forming device according to a fourth embodiment of the present invention. The fourth embodiment is the combination of the second and third embodiments. That is, the bearing sleeve 190B made from synthetic resin is interposed between the bearing hole 190A and the other end portion 84B of the shaft 84 to reduce sliding resistance to the angular rotation of the shaft 84. Thus, insufficient detection due to the sliding resistance can be avoided or restrained even by the application of smaller rotational force to the actuator 80. Further, the bearing plate 261A extends from the front chute cover 261 to allow the other end portion 84B to pass through the bearing hole 261B. Thus, the other end portion 84B will not be displaced even by the displacement of the detection board 90.In the latter case, sliding resistance may be increased. However, the bearing sleeve 190B can reduce the sliding resistance.

FIGS. 16 through 18(B) show a front chute portion 460 in an image forming device according to a fifth embodiment of the present invention. In the fifth embodiment, a supplemental shaft support 479 is provided to the inner surface of a chute cover 461. The supplemental shaft support 479 includes a support arm 473 extending from the inner surface of a front chute cover 461 at a position close to the other end portion 84B of the shaft, and an annular boss 472 integrally protruding from a side surface of the support arm 473 toward the one end portion 84A. A bearing hole 471 extends through the boss 472 and the support arm 473 for allowing the other end portion 84B to pass therethrough for rotatably supporting the same. The annular boss 472 has an outer diameter equal to an inner diameter of the bearing hole 90A of the detection board 90, so that the boss 472 is fittingly inserted through the bearing hole 90A for positioning the detection board 90 relative to the front chute cover 461. The support arm 473 is provided integrally with the front chute cover 461 made from synthetic resin.

The support arm 473 is in the form of a flat plate shape extending in frontward/rearward direction and vertical direction. A board holding rib 475 extends from the front chute cover 461 at one side of the support arm 473, the one side being a side from which the annular boss 472 protrudes. Thus, an upper end portion of the detection board 90 is nipped between the support arm 473 and the board holding rib 475. The lower end portion of the detection board 90 is held by the lower slit 65*a* as in the foregoing embodiments. Thus, the detection board 90 is subjected to positioning in the lateral direction.

For attachment of the actuator 80, the detection board 90 is firstly attached to the front chute cover 461. More specifically, the support arm 473 is flexed, against its resiliency, in a direction away from the board holding rib 475, and then the detection board 90 is inserted between the support arm 473 and the board holding rib 475 so as to fit the annular boss 472 with the bearing hole 90A. Then the support arm 473 restores its original shape because of its resiliency, thereby ensuring fitting engagement between the boss 472 and the bearing hole 90A.

Then, the one end portion 84A of the shaft 84 is inserted into the elongated slot 63*a*, and the shaft 94 is axially moved toward its one end portion 84A. Then, the shaft is slidingly moved toward its other end portion 84B to permit the other end portion 84B to be inserted into the bearing hole 471 of the supplemental shaft support.

According to the fifth embodiment, each end portion 84A, 84B of the shaft 84 is supported to the chute cover 461, and therefore, smooth angular rotation of the actuator 80 can result. Further, relative positional accuracy between the detection board 90 and the front chute cover 461 and between the detection board 90 and the actuator 80 can be improved.

Further, the detection board 90 is subject to positioning by fitting engagement of the boss 472 with the bearing hole 90A. Therefore, simplified structure of board support 65 can result. More specifically, the hook 65C can be dispensed with since disengagement of the detection board 90 can be avoided because of the fitting engagement between the boss 472 and the bearing hole 90A. Consequently, the through-hole 65D and the rectangular recess 72A can be dispensed with. Further, angular displacement and vertical displacement of the detection board 90 can be avoided by the engagement between the front/bottom recess 90C and the lower retainer 65A at its front end portion of the slit 65*a*. Therefore, the above-described front recess 90B, the engagement rib 65E and the stop rib 65F can be omitted. Consequently, simple arrangement can be provided in the fifth embodiment. Incidentally, the upper retainer 65B can be provided in the fifth embodiment. In the latter case, a design freedom with respect to a configuration of the support arm 473 and its position can be improved.

Figure 19A:
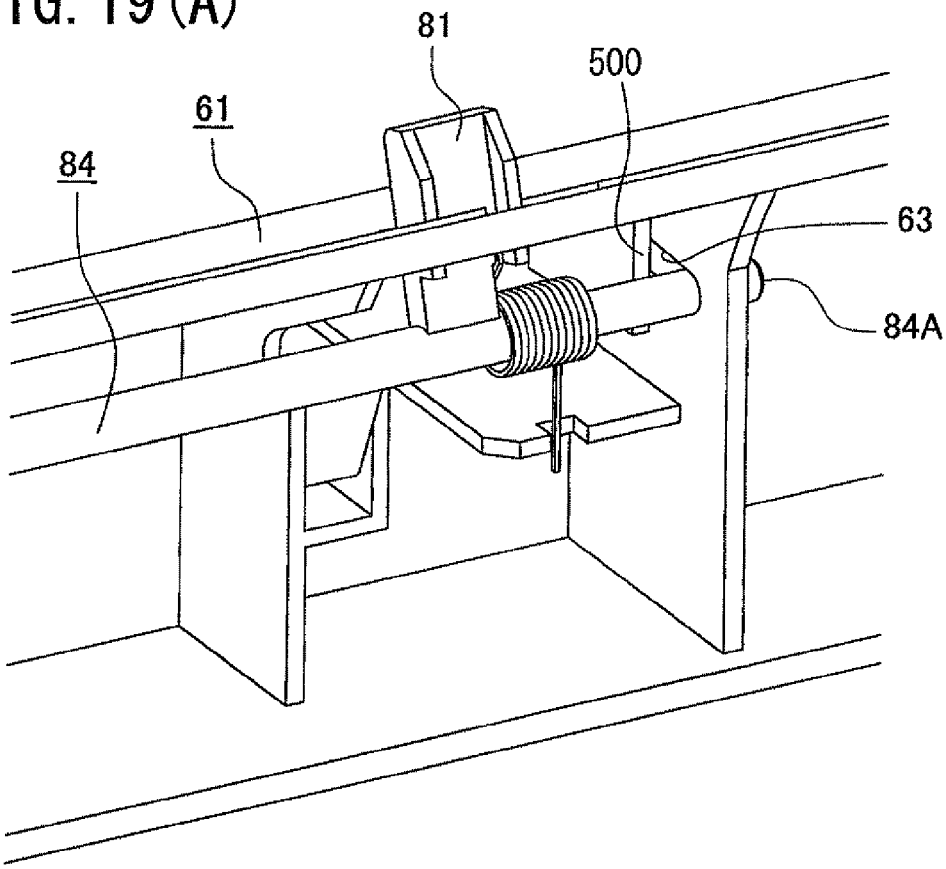
FIG. 19(A) is a partial perspective view showing an essential portion of a front chute portion in an image forming device according to a sixth embodiment of the present invention; and, FIG. 19(B) is a cross-sectional view of the front chute portion according to the sixth embodiment.
Figure 19B:
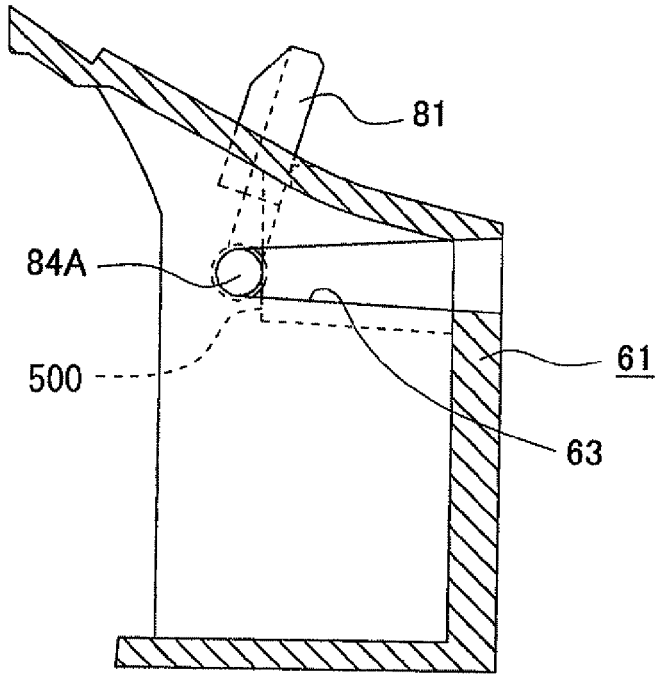

FIGS. 19(A) and 19(B) show a front chute portion 560 in an image forming device according to a sixth embodiment of the present invention. In the first embodiment as shown in FIG. 4(B), the one end portion 84A is positioned at the front end side of the elongated slot 63*a* by the cooperation of the arcuate notched portion 64A. In the sixth embodiment, a rib 500 is positioned close to the elongated slot 63*a* of the shaft support 63, so that a front end of the rib 500 is in close confrontation with the shaft 84. With this arrangement, one end portion 84A of the shaft can be stably positioned at the front end side of the elongated slot 63*a*, since the rib 500 is positioned closer to the elongated slot 63*a* than the notched portion 64A to the elongated slot 63*a*.

In the above-described embodiments, the detection target is the sheet 4. However, the present invention is available for detecting a target other than the sheet, such as a developing cartridge 34. That is, the abutment portion is adapted to be pivotally moved when the developing cartridge 34 is brought into abutment with the abutment portion in case of installation of the developing cartridge 34 into the casing 2 for the purpose of replacement of the cartridge. As a result of detection, the assembly of the developing cartridge at its accurate position can be recognized.

The present invention is available for various type image forming devices such as an intermediary image transfer type color laser printer, a four cycle type color laser printer, a monochromatic laser printer, an ink jet printer, a facsimile machine, and a copying machine etc., in addition to the direct tandem type color laser printer. If the invention is applied to the facsimile machine or the copying machine, the above described abutment portion 81 is used for a detection of an original manuscript.

Further, in the above-described embodiment, the pivotal movement of the actuator 80 is detected by the photo-interrupter 91. However, various detection elements are available, for example, a hall element. Still however, the photo-interrupter is advantageous in that the detection can be made as long as the detected portion shuts off the optical passage, thereby simplifying the configuration of the detected portion in comparison with the employment of the hall element. Further, the detecting element can be used to directly detect the abutment portion 81. In the latter case, the abutment portion 81 serves as the detected portion.

While the invention has been described in detail with reference to the embodiments thereof, it would be apparent to those skilled in the art that various changes and modifications may be made therein without departing from the spirit of the invention.

What is claimed is:

1. An image forming device comprising:

an image forming unit for forming an image on a recording medium;

an actuator comprising a shaft having a first end portion and a second end portion, the shaft defining an axis, an abutment portion pivotally movable about the axis upon abutment of a detection target onto the abutment portion and a detected portion movable integrally with the abutment portion and pivotable between a detected position and a non-detected position;

a print circuit board having a hole and a detection unit configured to detect the detected portion upon the detected portion being moved to the detected position;

a chute cover configured to guide the recording medium and comprising a board support configured to support the print circuit board; and an urging member configured to urge the actuator to rotate in a predetermined direction;

wherein the first end portion of the shaft of the actuator is inserted into the hole to fix a relative positional relationship between the shaft and the print circuit board; and wherein the chute cover further comprises a shaft support portion configured to rotatably support the second end portion of the shaft of the actuator; and wherein the urging member is positioned such that a distance from the urging member to the shaft support portion on the chute cover is smaller than a distance from the urging member to the print circuit board.

2. The image forming device as claimed in claim 1, further comprising a supplemental shaft support extending from the base component for rotatably supporting the another end portion of the shaft.

3. The image forming device as claimed in claim 2, wherein the detection board is formed with a through-hole, and, the image forming device further comprising a sleeve bearing fitted in the through-hole for rotatably supporting the another end portion.

4. The image forming device as claimed in claim 2, wherein the detection board is formed with a through-hole through which the another end portion extends, and wherein the supplemental shaft support comprises a support arm extending from the base component, and an annular boss integrally protruding from the support arm and fittingly extending through the through-hole, a bearing hole extending through the boss and the support arm for allowing the another end portion to pass therethrough.

5. The image forming device as claimed in claim 4, wherein the supplemental shaft support further comprises a holding rib extending from the base component at a position in confrontation with the support arm, the detection board being resiliently nipped between the support arm and the holding rib.

6. The image forming device as claimed in claim 4, wherein the supplemental shaft support is made from a resin.

7. The image forming device as claimed in claim 1, wherein the detection board is formed with a through-hole, and, the image forming device further comprising a sleeve bearing fitted in the through-hole for rotatably supporting the another end portion.

8. The image forming device as claimed in claim 1, wherein the shaft support portion of the chute cover is formed with an elongated slot for rotatably supporting the second end portion of the shaft, and wherein the chute cover further comprises a shaft positioning portion for positioning the second end portion of the shaft to an end portion of the elongated slot.

9. The image forming device as claimed in claim 1, wherein the detection unit comprises a photo-interrupter having a light emitting element and a light receiving element to provide an optical path therebetween, the optical path being shut off when the detected portion is moved to the detected position.

10. The image forming device as claimed in claim 1, wherein the detection target is one of an image recording medium, an original, and a detachable component.

* * * * *